US010343035B2

(12) United States Patent
Chen et al.

(10) Patent No.: US 10,343,035 B2
(45) Date of Patent: Jul. 9, 2019

(54) GOLF CLUB HEADS WITH CAVITIES AND INSERTS

(71) Applicant: KARSTEN MANUFACTURING CORPORATION, Phoenix, AZ (US)

(72) Inventors: Xiaojian Chen, Phoenix, AZ (US); Martin R. Jertson, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 14/693,733

(22) Filed: Apr. 22, 2015

(65) Prior Publication Data

US 2016/0144248 A1 May 26, 2016

Related U.S. Application Data

(63) Continuation-in-part of application No. 14/555,025, filed on Nov. 26, 2014, now abandoned.

(51) Int. Cl.

| | |
|---|---|
| ***A63B 53/04*** | (2015.01) |
| *A63B 60/52* | (2015.01) |
| *A63B 60/54* | (2015.01) |

(52) U.S. Cl.

CPC ..... *A63B 53/047* (2013.01); *A63B 53/0475* (2013.01); *A63B 60/52* (2015.10); *A63B 60/54* (2015.10); *A63B 2053/0408* (2013.01); *A63B 2053/0433* (2013.01); *A63B 2053/0491* (2013.01)

(58) Field of Classification Search

CPC . A63B 3/0475; A63B 53/048; A63B 53/0475; A63B 2053/0491

USPC ..... 473/349, 350

See application file for complete search history.

(56) References Cited

U.S. PATENT DOCUMENTS

| | | | | |
|---|---|---|---|---|
| 2,846,228 A | | 8/1958 | Reach | |
| D244,558 S | | 5/1977 | Elkins, Jr. | |
| 4,147,349 A | * | 4/1979 | Jeghers | A63B 53/04 473/291 |
| 4,247,105 A | * | 1/1981 | Jeghers | A63B 53/04 473/291 |
| 4,355,808 A | | 10/1982 | Jernigan et al. | |
| 4,523,759 A | | 6/1985 | Igarashi | |
| 4,645,207 A | | 2/1987 | Teramoto et al. | |
| 4,836,550 A | | 6/1989 | Kobayashi | |

(Continued)

OTHER PUBLICATIONS

International Search Report and Written Opinion of the International Searching Authority from corresponding PCT Application No. PCT/US2012/042698, dated Dec. 17, 2012 Dec. 17, 2012.

*Primary Examiner* — William M Pierce

(57) ABSTRACT

Embodiments of golf club heads with cavities and methods to manufacture golf club heads with cavities are generally described herein. Some embodiments include a golf club head comprising a body. The body comprises a strikeface, a backside of the strikeface, a heel region, a toe region opposite the heel region, a sole, and a rear portion opposite the strikeface. In many embodiments, the body further comprises a first cavity at the backside of the strikeface and located between the strikeface and the rear portion, and a second cavity at the rear portion. In some embodiments, the first cavity and the second cavity are directly coupled to each other to form a single, aggregate cavity. Other embodiments may be described and claimed.

24 Claims, 9 Drawing Sheets

(56) References Cited

U.S. PATENT DOCUMENTS 4,934,711 A * 6/1990 Runstein ..... A63F 3/0423 273/272
5,054,788 A * 10/1991 Kirby ..... A63F 3/0423 273/272
5,207,427 A 5/1993 Saeki
5,255,918 A * 10/1993 Anderson ..... A63B 53/04 473/330
5,290,036 A 3/1994 Fenton
5,346,219 A * 9/1994 Pehoski ..... A63B 53/0487 473/325
5,385,348 A * 1/1995 Wargo ..... A63B 53/08 473/291
5,492,327 A * 2/1996 Biafore, Jr. ..... A63B 53/04 473/332
5,586,947 A 12/1996 Hutin
5,588,923 A * 12/1996 Schmidt ..... A63B 53/04 473/324
5,779,560 A 7/1998 Buck
5,913,735 A * 6/1999 Kenmi ..... A63B 53/04 29/447
5,967,903 A 10/1999 Cheng
6,086,485 A * 7/2000 Hamada ..... A63B 53/04 473/329
6,093,112 A * 7/2000 Peters ..... A63B 53/00 473/291
6,193,614 B1 2/2001 Sasamoto
6,196,936 B1 3/2001 Meckel
6,277,032 B1 * 8/2001 Smith ..... A63B 53/04 473/336
6,368,231 B1 4/2002 Chen
6,379,263 B2 4/2002 Erickson et al.
6,398,670 B1 6/2002 Engelhardt et al.
6,419,593 B1 7/2002 Heinrich
6,454,665 B2 9/2002 Antonious
6,482,104 B1 * 11/2002 Gilbert ..... A63B 53/04 473/287
6,607,450 B1 8/2003 Hackman
6,638,183 B2 * 10/2003 Takeda ..... A63B 53/047 473/335
6,719,641 B2 4/2004 Dabbs
6,729,972 B2 5/2004 Boord
6,769,692 B1 * 8/2004 Cavalluzzo ..... A63F 3/0423 273/272
6,811,496 B2 * 11/2004 Wahl ..... A63B 53/047 473/334
6,884,180 B2 4/2005 Corzilius et al.
7,040,998 B2 5/2006 Jolliffe et al.
7,044,467 B1 * 5/2006 Dimmig ..... A63F 3/04 273/272
7,077,763 B2 7/2006 Wahl et al.
7,169,057 B2 1/2007 Wood et al.
7,186,188 B2 * 3/2007 Gilbert ..... A63B 53/047 473/290
7,192,362 B2 * 3/2007 Gilbert ..... A63B 53/047 473/291
D596,257 S 7/2009 Jertson et al.
7,614,962 B1 * 11/2009 Clausen ..... A63B 53/047 473/291
7,621,822 B2 11/2009 Roach
7,670,232 B2 3/2010 Franklin et al.
7,744,485 B2 6/2010 Jones et al.
7,803,062 B2 9/2010 Gilbert
7,891,665 B1 * 2/2011 Nathanson ..... A63F 3/00895 206/315.1
8,182,364 B2 5/2012 Cole et al.
8,221,261 B2 7/2012 Curtis
8,235,841 B2 * 8/2012 Stites ..... A63B 53/0466 473/328
8,262,495 B2 * 9/2012 Stites ..... A63B 53/047 473/226
8,366,566 B1 2/2013 Rollinson
8,403,771 B1 * 3/2013 Rice ..... A63B 53/04 473/328
8,430,763 B2 * 4/2013 Beach ..... A63B 53/06 473/307
8,480,514 B2 7/2013 Hartwell
8,506,415 B2 8/2013 Franklin
8,517,859 B2 8/2013 Golden
8,535,176 B2 9/2013 Bazzel et al.
8,696,491 B1 * 4/2014 Myers ..... A63B 53/06 473/334
8,721,472 B2 * 5/2014 Kuan ..... A63B 53/0487 473/338
8,740,721 B2 6/2014 Yamamoto
8,753,225 B1 * 6/2014 Abbott ..... A63B 53/06 473/334
8,894,506 B1 * 11/2014 Myers ..... A63B 53/0466 473/334
8,900,069 B2 12/2014 Beach
8,911,301 B1 12/2014 Allen
8,911,302 B1 12/2014 Ivanova
8,986,133 B2 3/2015 Bennett
9,033,818 B2 5/2015 Myrhum
9,550,097 B1 * 1/2017 Myers ..... A63B 53/06
2001/0055996 A1 12/2001 Iwata et al.
2002/0004427 A1 * 1/2002 Cheng ..... A63B 53/04 473/338
2002/0042307 A1 4/2002 Deshmukh
2002/0183134 A1 12/2002 Allen et al.
2003/0038424 A1 * 2/2003 Kummer ..... A63F 3/0423 273/272
2003/0157995 A1 8/2003 Mahaffey
2003/0232659 A1 * 12/2003 Mahaffey ..... A63B 53/0466 473/256
2004/0043830 A1 * 3/2004 Imamoto ..... A63B 53/047 473/332
2004/0092331 A1 * 5/2004 Best ..... A63B 53/047 473/332
2004/0142764 A1 7/2004 Sano
2005/0006844 A1 * 1/2005 Cavallo ..... A63F 3/0423 273/272
2005/0020376 A1 1/2005 Huang
2005/0046111 A1 * 3/2005 Orner ..... A63F 3/0423 273/272
2005/0085309 A1 4/2005 McGann et al.
2005/0143188 A1 6/2005 Tseng
2005/0181888 A1 8/2005 Hou
2005/0192116 A1 * 9/2005 Imamoto ..... A63B 53/0475 473/329
2005/0215340 A1 9/2005 Stites et al.
2005/0230914 A1 * 10/2005 Campbell ..... A63F 9/0001 273/272
2005/0282655 A1 12/2005 Sasaki
2005/0285338 A1 * 12/2005 Cusolito ..... A63F 3/0423 273/146
2006/0022407 A1 * 2/2006 Jensen ..... A63F 3/04 273/272
2006/0122004 A1 * 6/2006 Chen ..... A63B 53/0466 473/335
2006/0178228 A1 * 8/2006 DiMarco ..... A63B 53/0466 473/334
2006/0199661 A1 9/2006 Deng
2006/0211514 A1 9/2006 Deshmukh
2006/0217216 A1 9/2006 Iizuka
2006/0234804 A1 10/2006 Gilbert
2006/0234808 A1 10/2006 Gilbert
2006/0234811 A1 10/2006 Gilbert et al.
2006/0240908 A1 * 10/2006 Adams ..... A63B 53/0466 473/334
2007/0049403 A1 3/2007 Chen
2007/0054751 A1 * 3/2007 Breier ..... A63B 53/0466 473/334
2007/0072698 A1 3/2007 Juang
2007/0078028 A1 4/2007 Huang
2007/0135231 A1 * 6/2007 Lo ..... A63B 53/0466 473/336
2007/0149316 A1 6/2007 Nishino
2007/0155534 A1 7/2007 Tsai et al.
2007/0178988 A1 * 8/2007 Tavares ..... A63B 53/04 473/334

(56) References Cited

U.S. PATENT DOCUMENTS

2007/0281796 A1 12/2007 Gilbert et al.
2008/0020861 A1* 1/2008 Adams ..... A63B 53/04 473/334
2008/0058119 A1* 3/2008 Soracco ..... A63B 53/04 473/350
2008/0076597 A1 3/2008 Roach et al.
2008/0096687 A1 4/2008 Chen
2008/0102982 A1* 5/2008 Wahl ..... A63B 53/047 473/335
2008/0119298 A1 5/2008 Buckley et al.
2008/0146370 A1* 6/2008 Beach ..... A63B 53/0466 473/336
2008/0187890 A1* 8/2008 Podurgiel ..... A63F 1/00 434/129
2008/0194354 A1* 8/2008 Nagai ..... A63B 53/0466 473/334
2008/0261715 A1* 10/2008 Carter ..... A63B 53/0466 473/291
2008/0318708 A1 12/2008 Clausen
2009/0017944 A1 1/2009 Savarese et al.
2009/0137339 A1* 5/2009 Nakano ..... A63B 53/0475 473/350
2009/0170629 A1 7/2009 Hilton
2009/0174142 A1* 7/2009 Sullivan ..... A63F 3/0423 273/272
2009/0203462 A1* 8/2009 Stites ..... A63B 53/0466 473/334
2009/0326688 A1 12/2009 Thomas et al.
2010/0009780 A1 1/2010 Doherty et al.
2010/0029406 A1* 2/2010 Stites ..... A63B 53/047 473/334
2010/0087269 A1 4/2010 Snyder
2010/0093459 A1 4/2010 Cole
2010/0222152 A1 9/2010 Jaekel et al.
2010/0261540 A1* 10/2010 Roach ..... A63B 53/04 473/291
2010/0264586 A1* 10/2010 Mifflin ..... A63F 3/0423 273/272
2011/0003649 A1 1/2011 Liu
2011/0009209 A1* 1/2011 Llewellyn ..... A63B 53/0466 473/336
2011/0009211 A1 1/2011 Chao et al.
2011/0118042 A1* 5/2011 Ramsauer ..... A63B 53/0487 473/252
2011/0183780 A1 7/2011 Leech et al.
2011/0201444 A1 8/2011 Stokke et al.
2011/0207551 A1* 8/2011 Breier ..... A63B 53/047 473/332
2011/0224012 A1 9/2011 Hashimoto et al.
2012/0034991 A1* 2/2012 Hartwell ..... A63B 53/047 473/290
2012/0083360 A1* 4/2012 Boyd ..... A63B 53/0466 473/337
2012/0157222 A1* 6/2012 Kii ..... A63B 53/00 473/290
2012/0196702 A1* 8/2012 Shimazaki ..... A63B 53/047 473/345
2012/0264537 A1 10/2012 Breier
2012/0289354 A1 11/2012 Cottam et al.
2012/0289360 A1* 11/2012 Breier ..... A63B 53/047 473/335
2013/0017903 A1* 1/2013 Takechi ..... A63B 53/047 473/332
2013/0053169 A1 2/2013 Dumas
2013/0109500 A1* 5/2013 Boyd ..... A63B 53/047 473/332
2013/0210543 A1 8/2013 Radcliffe
2013/0241149 A1* 9/2013 Cloud ..... A63F 3/0423 273/272
2013/0281227 A1* 10/2013 Roach ..... A63B 53/0475 473/332
2013/0324301 A1 12/2013 Boyd
2013/0331201 A1* 12/2013 Wahl ..... A63B 53/0475 473/329
2013/0344988 A1* 12/2013 Hettinger ..... A63B 53/047 473/349
2013/0344989 A1* 12/2013 Hebreo ..... A63B 53/047 473/349
2014/0073447 A1* 3/2014 Golden ..... A63B 53/047 473/291
2014/0274454 A1 9/2014 Snyder
2015/0217364 A1* 8/2015 Zimmerman ..... B21K 17/00 72/352
2015/0273287 A1* 10/2015 Doi ..... A63B 53/047 473/350
2015/0297961 A1* 10/2015 Voshall ..... A63B 53/06 473/335
2015/0306475 A1* 10/2015 Curtis ..... A63B 53/06 473/337
2015/0314176 A1* 11/2015 Liang ..... A63B 53/06 473/336
2015/0321055 A1* 11/2015 Golden ..... A63B 53/0466 473/338
2015/0328506 A1* 11/2015 Morales ..... A63B 53/047 473/331
2015/0367193 A1* 12/2015 Boggs ..... A63B 53/04 473/336
2016/0051869 A1* 2/2016 Foster ..... A63B 53/06 473/335
2016/0059093 A1* 3/2016 Nielson ..... A63B 53/02 473/338
2016/0074720 A1* 3/2016 Kline ..... A63B 53/06 473/223
2016/0101330 A1* 4/2016 Harrington ..... A63B 53/047 473/338
2016/0144248 A1* 5/2016 Chen ..... A63B 53/047 473/350
2016/0184669 A1* 6/2016 Deshmukh ..... A63B 53/0475 473/335
2016/0310809 A1* 10/2016 Boggs ..... A63B 60/02
2016/0317880 A1* 11/2016 Boggs ..... A63B 53/0466
2017/0028270 A1* 2/2017 Westrum ..... A63B 53/047
2017/0028271 A1* 2/2017 Petersen ..... A63B 53/047
2017/0312593 A1* 11/2017 Myers ..... A63B 53/065

* cited by examiner

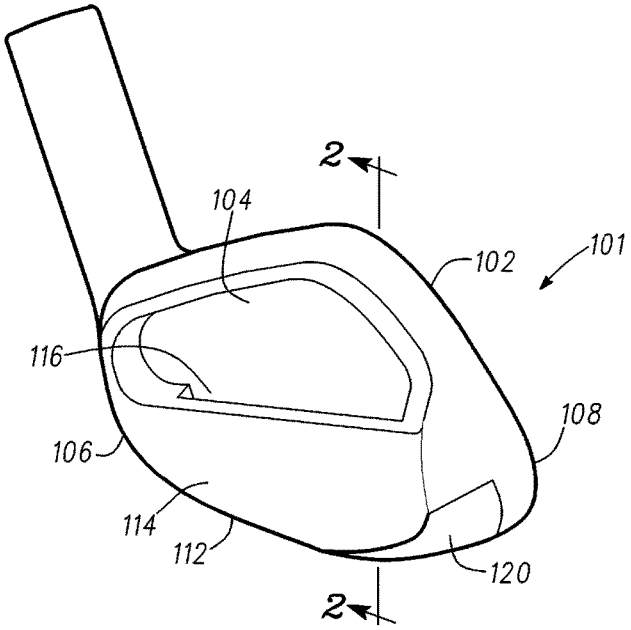
Fig. 1
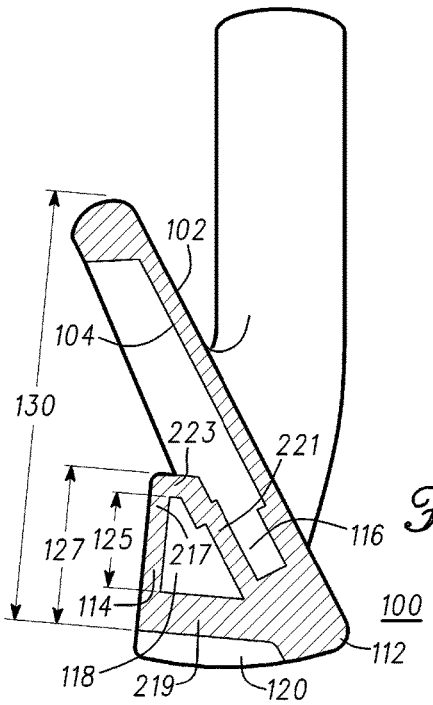
Fig. 2
Fig. 3
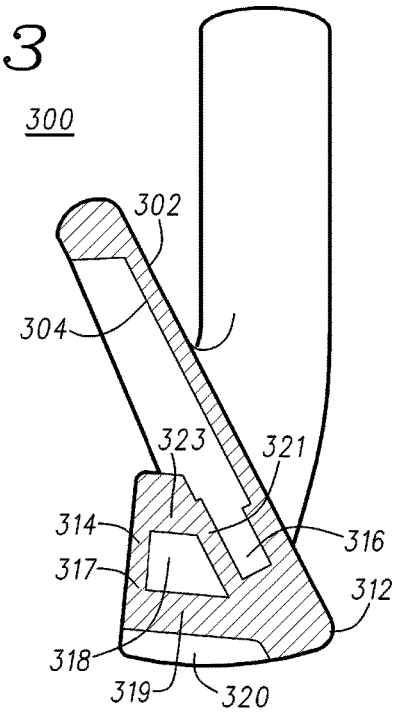

GOLF CLUB HEADS WITH CAVITIES AND INSERTS

CROSS-REFERENCE TO RELATED APPLICATIONS

This is a continuation in part of U.S. patent application Ser. No. 14/555,025, filed Nov. 26, 2014, and titled "Golf Club Heads with Cavities And Related Methods." The contents of the disclosures listed above are incorporated herein by reference.

TECHNICAL FIELD

This disclosure relates generally to golf clubs, and relates more particularly to golf club heads with cavities.

BACKGROUND

Golf club manufacturers have designed golf club heads to accommodate the preferences of an individual user as well as the individual user's golfing ability. Some golf club manufactures have designed golf club heads to accommodate the preferences of an individual user, such as an individual user's preference on the golf club head's look and feel. Some individual users may prefer a heavy look, such as a muscleback iron. Golf club manufacturers have designed golf club heads to accommodate the preferences of an individual user while designing golf club heads with enhanced weight distribution and/or a lower center of gravity.

BRIEF DESCRIPTION OF THE DRAWINGS

To facilitate further description of the embodiments, the following drawings are provided in which:

FIG. 1 depicts back, toe-side perspective view of a golf club head according to an embodiment;

FIG. 2 depicts the golf club head of FIG. 1 along the cross-sectional line 2-2 in FIG. 1;

FIG. 3 depicts a golf club head similar to the golf club head of FIG. 1 along the cross-sectional line 2-2 in FIG. 1, according to another embodiment;

Figure 4:
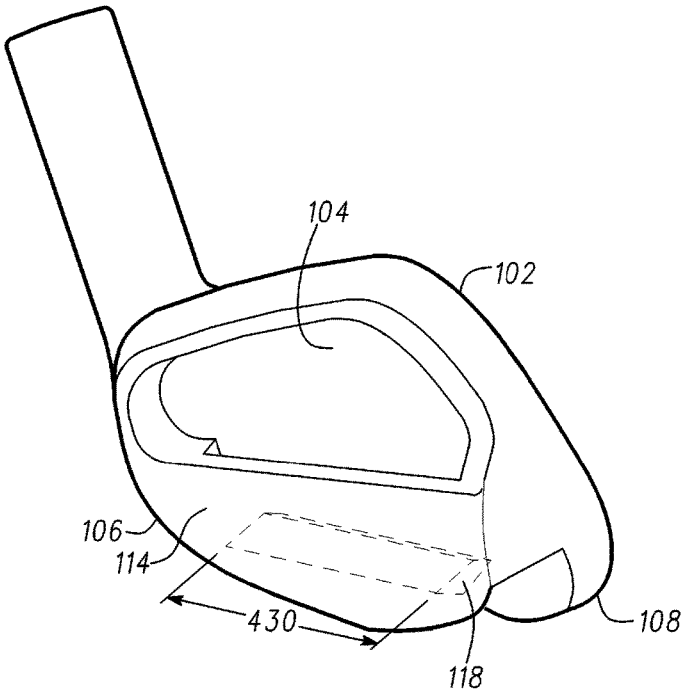
FIG. 4 depicts a back, toe-side perspective, x-ray view of the golf club head of FIG. 1.

For simplicity and clarity of illustration, the drawing figures illustrate the general manner of construction, and descriptions and details of well-known features and techniques may be omitted to avoid unnecessarily obscuring the golf clubs and their methods of manufacture. Additionally, elements in the drawing figures are not necessarily drawn to scale. For example, the dimensions of some of the elements in the figures may be exaggerated relative to other elements to help improve understanding of embodiments of the golf club heads with cavities and related methods. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments of golf club heads with cavities and related methods herein are, for example, capable of operation in sequences other than those illustrated or otherwise described herein. Furthermore, the terms "contain," "include," and "have," and any variations thereof, are intended to cover a non-exclusive inclusion, such that a process, method, article, or apparatus that comprises a list of elements is not necessarily limited to those elements, but may include other elements not expressly listed or inherent to such process, method, article, or apparatus.

The terms "left," "right," "front," "back," "top," "bottom," "side," "under," "over," and the like in the description and in the claims, if any, are used for descriptive purposes and not necessarily for describing permanent relative positions. It is to be understood that the terms so used are interchangeable under appropriate circumstances such that the embodiments of golf clubs and methods of manufacture described herein are, for example, capable of operation in other orientations than those illustrated or otherwise described herein.

The terms "couple," "coupled," "couples," "coupling" and the like as used herein, is defined as directly or indirectly connected in a physical, mechanical, or other manner. Two or more mechanical elements may be mechanically coupled together, but not electrically or otherwise coupled together. Coupling many be for any length of time, e.g., permanent or only for an instant.

"Mechanical coupling" and the like should be broadly understood and include mechanical coupling of all types.

The absence of the word "removably," "removable," and the like near the word "coupled," and the like does not mean that the coupling, etc. in question is or is not removable.

DESCRIPTION OF EXAMPLES OF EMBODIMENTS

Various embodiments include a golf club head comprising a body. The body comprises a strikeface, a backside of the strikeface, a heel region, a toe region opposite the heel region, a sole, and a rear portion opposite the strikeface. In many embodiments, the body further comprises a first cavity at the backside of the strikeface and a second cavity at the rear portion. In some embodiments, the golf club head also comprises a cap closing off the second cavity.

Some embodiments include a golf club comprising a shaft, a grip and a golf club head. The golf club head comprises a body. The body comprises a strikeface, a backside of the strikeface, a heel region, a toe region opposite the heel region, a sole, and a rear portion opposite the strikeface. In many embodiments, the body further comprises a first cavity at the backside of the strikeface and a second cavity at the rear portion. In some embodiments, the golf club head also comprises a cap closing off the second cavity.

Other embodiments include a method for manufacturing a golf club head. In many embodiments, the method comprises forming a body from a first material having a first density. The body having a strikeface, a backside of the strikeface, a heel region, a toe region opposite the heel region, a sole, a first cavity at the backside of the strikeface, and a rear portion opposite the strikeface. In some embodiments, the method can also comprise forming a second cavity at the rear portion and affixing a cap at the second cavity to close off the second cavity.

Various embodiments include a golf club head comprising a body. The body comprises a strikeface, a backside of the strikeface, a heel region, a toe region opposite the heel region, a sole, and a rear portion opposite the strikeface. In many embodiments, the body further comprises a first cavity at the backside of the strikeface and located between the strikeface and the rear portion, and a second cavity at the rear portion. In some embodiments, the first cavity and the second cavity are directly coupled to each other to form a single, aggregate cavity.

Some embodiments include a golf club comprising a shaft, a grip coupled to the shaft, and a golf club head coupled to the shaft. The golf club head comprises a body. The body comprises a strikeface, a backside of the strikeface, a heel region, a toe region opposite the heel region, a sole, and a rear portion opposite the strikeface. In many embodiments, the body further comprises a first cavity at the backside of the strikeface and located between the strikeface and the rear portion, and a second cavity at the rear portion. In many embodiments, the first cavity and the second cavity are directly coupled to each other to form a single, aggregate cavity.

Other embodiments include a method for manufacturing a golf club head. In many embodiments the method comprises forming a body from a first material having a first density. The body having a strikeface, a backside of the strikeface, a heel region, a toe region opposite the heel region, a sole, a rear portion opposite the strikeface, a first cavity at the backside of the strikeface and located between the strikeface and the rear portion, and a second cavity at the rear portion. In some embodiments, the first cavity and the second cavity are directly coupled to each other to form a single, aggregate cavity.

Turning to the drawings, FIG. 1 illustrates a back, toe-side perspective view of a golf club head 100 according to an embodiment. Golf club head 100 is merely exemplary and is not limited to the embodiments presented herein. Golf club head 100 can be employed in many different embodiments or examples not specifically depicted or described herein.

In some embodiments, golf club head 100 can be an iron-type golf club head. In other embodiments, golf club head 100 can be another type of golf club head (e.g., a driver-type club head, a fairway wood-type club head, a hybrid-type club head, a wood-type club head, a wedge-type club head, or a putter-type club head.) In some embodiments, golf club head 100 comprises a body 101. In many embodiments, body 101 comprises a strikeface 102, a backside 104 of strikeface 102, a heel region 106, a toe region 108 opposite heel region 106, and a sole 112 at the bottom of body 101. Body 101 can further comprise a first cavity 116 at backside 104. Further, body 101 can comprise a rear portion 114 opposite strikeface 102. First cavity 116 can be between backside 104 and rear portion 114. In some embodiments, golf club head 100 can comprise a hosel, which in other embodiments, can be omitted. In many embodiments, rear portion 114 can be designed to look similar to a traditional muscleback iron golf club head. For example, many muscleback irons have a full back or full rear portion of a golf club head. Muscleback irons differ from non-muscleback irons in which the rear or back of the golf club head has been hollowed out to at least partially remove the muscleback, full back and/or rear portion. In some embodiments, rear portion 114 can be designed to provide a heavy or thick look to the golf club head.

Some users may prefer a heavy look to a golf club head, such as a muscleback golf club head. However, in many instances, a muscleback golf club head may not provide an enhanced weight distribution and/or a lower center of gravity. For instance, muscleback irons with wide soles can add weight high and in the middle of the golf club head. Also, many muscleback golf clubs may have a greater loss of distance compared to non-muscleback golf clubs. Additionally, many muscleback golf clubs have a lower moment of inertia, or forgiveness, than a non-muscleback golf club. For users who prefer the heavy look to a golf club head, but would like an enhanced weight distribution, higher moment of inertia and/or a lower center of gravity, a second cavity within the rear portion or muscleback portion of the golf club head can be designed.

In some embodiments, the higher moment of inertia can be at least partially due to perimeter weighting. In other embodiments, the higher moment of inertia can be at least partially due to a second cavity in body 101. For example, in many embodiments, body 101 further comprises a second cavity 118 (FIG. 2) at or within rear portion 114. In some embodiments, second cavity 118 can be designed to enhance weight distribution of golf club head 100, while maintaining a heavy or muscleback look of rear portion 114. In some embodiments, second cavity 118 can be hollow, thereby reducing the mass and/or weight of rear portion 114. In other embodiments, second cavity 118 can be at least partially hollow. In other embodiments, second cavity 118 can comprise a filler material in all or a portion of second cavity 118. In embodiments wherein second cavity 118 comprises the filler material, the filler material can be less dense than the material(s) used for other parts of body 101 (i.e., the club head density).

In some embodiments, second cavity 118 can comprise an opening at least partially at toe region 108. In some embodiments, second cavity 118 can comprise an opening at least partially at sole 112. In some embodiments, second cavity 118 can comprise an opening at least partially at heel region 106. In many embodiments, and as shown in FIG. 1, second cavity 118 comprises an opening at least partially at toe region 108 and at least partially at sole 112 and does not comprise an opening at heel region 106. In some embodiments, second cavity 118 can be open to first cavity 116 to form one larger cavity. In some embodiments, wherein second cavity 118 is open to first cavity 116, the one larger cavity can comprise at least two distinct regions. In other embodiments, wherein second cavity 118 is open to first cavity 116, the one larger cavity can comprise a single region.

In some embodiments, second cavity 118 can be formed by removing an inner rear portion material from rear portion 114. The inner rear portion material can be removed from an opening in rear portion 114. In many embodiments, the inner rear portion material can be removed from an opening at toe region 108. In some embodiments, the inner rear portion material can be removed from an opening at sole 112 and/or an opening at heel region 106. In some embodiments, second cavity 118 can be formed by using a pull piece to remove the inner rear portion to create second cavity 118. In some embodiments, approximately 8 grams (g) to approximately 30 g of material from the inner rear portion material can be removed to form second cavity 118. In some embodiments, approximately 10 g, 11 g, 12 g, 13 g, 14 g, 15 g, 16 g, 17 g, 18 g, 19 g, 20 g, 21 g, 22 g, 23 g, or 24 g of the inner rear portion material can be removed to form second cavity 118. In some embodiments, approximately 10 g to approximately 15 g of the inner rear portion material can be removed to form second cavity 118.

Figure 5:
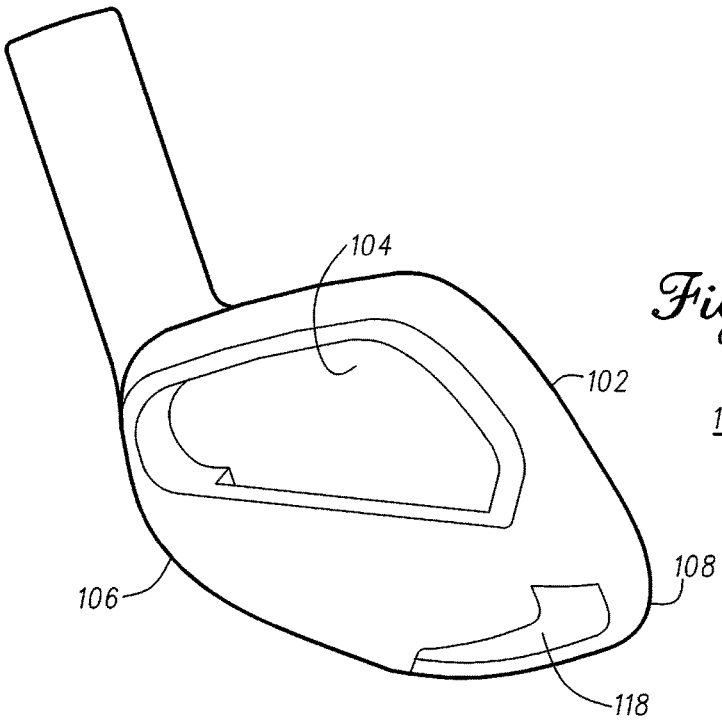
FIG. 5 depicts a back, toe-side perspective view of the golf club head of FIG. 1 according to another embodiment.

In many embodiments, mass removed and/or missing from second cavity 118 can be redistributed as perimeter weighting in golf club head 100. For example, in various embodiments, golf club head 100 can further comprise a cap 120 (FIG. 1) closing off second cavity 118. Cap 120 can provide perimeter weighting for golf club head 100. In other embodiments, such as FIG. 5, (which illustrates a back, toe-side perspective view of golf club head 100 of FIG. 1 according to an embodiment) golf club head 100 may not comprise a cap closing off second cavity 118, and second cavity 118 can be at least partially open to the environment.

In FIG. 1, cap 120 is shown at least partially at toe region 108 and at least partially at sole 112 of golf club head 100. In other embodiments, cap 120 can be located at least partially in sole 112, at least partially in toe region 108, and/or at least partially in the back of rear portion 114. In some embodiments, cap 120 can close off second cavity 118 and can cover the cavity 118 opening in body 101. In embodiments wherein there is an opening in heel region 106, cap 120 can be at least partially located in heel region 106. In other embodiments when there is an opening in sole region 112, cap 120 can be at least partially located in sole region 112. In some embodiments, cap 120 can be at least partially located in rear portion 114. In embodiments wherein second cavity 118 comprises an opening in heel region 106, cap 120 in heel region 106 can be lightweight or have a cap density that is less dense than the golf club head density of body 101. In embodiments wherein second cavity 118 comprises an opening in toe region 108, the cap density of cap 120 can be higher than a club head density of body 101. In some embodiments, cap 120 can comprise tungsten. In some embodiments, cap 120 can comprise steel. In some embodiments, cap 120 can comprise polyester based polyurethane resin (TPU). In some embodiments, cap 120 can comprise glass or metal fillers. In some embodiments, cap 120 can comprise tungsten, TPU and/or glass and/or metal fillers. In some embodiments, cap 120 comprising TPU can have a specific gravity of 1, 2, 3, 4, 5, 6, 7, 8, or 9, and a shore hardness of 45D, 50D, 55D, 60D, 65D, or 70D.

In some embodiments, cap 120 can comprise styrene isoprene styrene block copolymer TPE resins (SIS). In some embodiments, cap 120 can comprise SIS, tungsten and/or glass and/or metal fillers. In some embodiments, cap 120 comprising SIS can have a specific gravity of 1, 3, 4, 5, 6, 7, 8, or 9, and a shore hardness of 50A, 52A, 54A, 56A, 58A, 60A, 62A, or 64A. In some embodiments, cap 120 can be welded to body 101. In other embodiments, cap 120 can be bonded and/or adhered to body 101. In some examples, cap 120 can be bonded or adhered using an adhesive.

In some embodiments, cap 120 can weigh approximately 3 g to approximately 30 g. In some embodiments, cap 120 can weigh approximately 3 g, 6 g, 9 g, 12 g, 15 g, 18 g, 21 g, 24 g, 27 g, or 30 g. In many embodiments, when cap 120 is at least partially located at toe region 108, cap 120 can move the center of gravity (cg) lower and toward toe region 108. In embodiments when cap 120 is at least partially located in toe region 108, cap 120 can raise the moment of inertia of body 101 and golf club head 100.

In many embodiments, cap 120 can be substantially flush with body 101. In some embodiments, cap 120 can be substantially flush with rear portion 114 such that rear portion 114 can appear substantially solid. In other embodiments, cap 120 can comprise an indication, such as a different coloring or marking, to indicate that rear portion 114 is at least partially hollow, comprises perimeter weighting, and/or is not substantially solid. In other embodiments, cap 120 can at least partially protrude from body 101. In other embodiments, cap 120 can be substantially within body 101.

Figure 9:
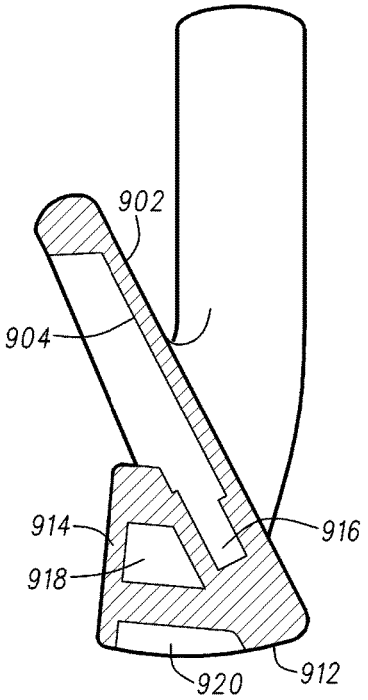
FIG. 9 depicts the golf club head of FIG. 10 along a similar cross-sectional line 9-9 in FIG. 10, according to an embodiment.
Figure 10:
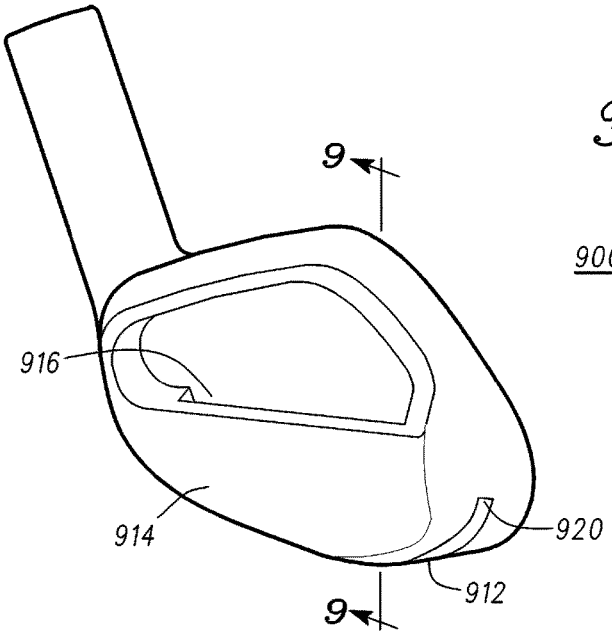
FIG. 10 depicts a back, toe-side perspective view of a golf club head, according to an embodiment.

As shown in FIG. 1, cap 120 can be partially at toe region 108 and partially at sole 112. In other embodiments, such as cap 920 of FIG. 9 and FIG. 10, cap 920 can be at least partially within sole 112 and not visible from the back of rear portion 914. In many embodiments, cap 920 can be similar to cap 120 of FIG. 1. FIG. 9 shows a golf club head 900 along the line 9-9 of FIG. 10. FIG. 10 shows a back, toe-side perspective view of golf club head 900, according to an embodiment. In many embodiments, golf club head 900 comprises cap 920 within sole 912 and not at the back of rear portion 914.

Returning to FIG. 1, in some embodiments, first cavity 116 can be substantially parallel to strikeface 102. In some embodiments, first cavity 116 can be forward of rear portion 114, as shown in FIG. 2. FIG. 2 illustrates golf club head 100 of FIG. 1 along the cross-sectional line 2-2 of FIG. 1. In some embodiments, second cavity 118 can be substantially parallel to strikeface 102.

Figure 7:
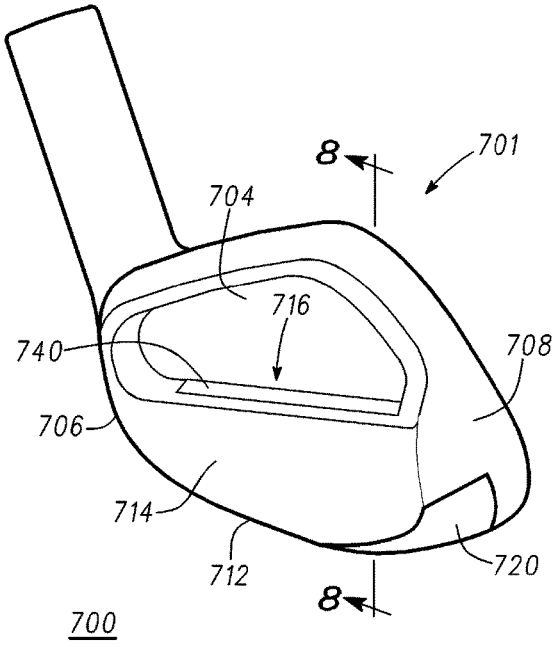
FIG. 7 depicts a back, toe-side perspective view of a golf club head according to an embodiment.
Figure 8:
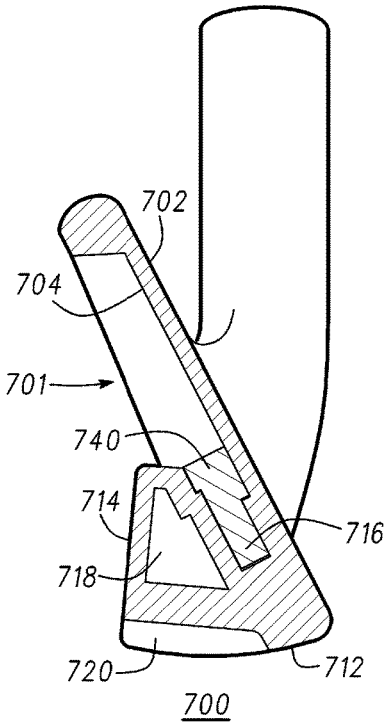
FIG. 8 depicts the golf club head of FIG. 7 along the cross-sectional line 7-7 in FIG. 7.

In some embodiments, first cavity 116 can be configured to receive an insert. For example, FIG. 8 illustrates an insert 740. FIG. 8 shows golf club head 700 along the cross-sectional line 7-7 of golf club head 700 in FIG. 7. FIG. 7 illustrates a back, toe-side perspective view of golf club head 700, according to an embodiment. As shown in FIGS. 7 and 8, golf club head 700 comprises a body 701. In many embodiments, body 701 of FIGS. 7 and 8 can be similar to body 101 of FIG. 1. Body 701 can comprise a strikeface 702, a backside 704 of strikeface 702, a heel region 706, a toe region 708 opposite heel region 706, a sole 712, a first cavity 716 at backside 704, a rear portion 714 opposite strikeface 702, a second cavity 718 (FIG. 8), and a cap 720 closing off second cavity 718. In some embodiments, first cavity 716 can be hollow. While in many embodiments, body 701 can further comprise insert 740 (as shown in FIG. 8) at least partially within first cavity 716. In some embodiments, insert 740 can comprise a custom tuning port weight and/or a filler insert. In some embodiments, an insert material of insert 740 can be more dense than a body material of body 701. In other embodiments, the insert material of insert 740 can be the same density or less dense than the golf club head material density of body 701. In other embodiments, insert 740 can comprise the same materials as described for cap 120 (FIG. 1).

Returning to FIG. 2, rear portion 114 can have a rear portion height 127. In many embodiments and as shown in FIG. 2, rear portion height 127 can be measured from the bottom of rear portion 114 (or from a top of cap 120) to a maximum height of rear portion 114 in a direction substantially perpendicular to ground when golf club head 100 is at address. Also as shown in FIG. 2, strikeface 102 can have a strikeface height 130. Strikeface height 130 can be measured from the bottom of rear portion 114 (or from a top of cap 120) to the top of strikeface 102 in a direction substantially perpendicular to ground when golf club head 100 is at address. As measured, strikeface height 130 can be substantially parallel to rear portion height 127. In many embodiments, rear portion height 127 can be approximately one-fourth to approximately one-half of strikeface height 130. In other embodiments, rear portion height 127 can be approximately one-half to approximately three-fourths of strikeface height 130. In some embodiments, rear portion height 127 can be equal to approximately one-half of strikeface height 130.

In various embodiments, second cavity 118 can comprise a second cavity height 125. In some embodiments, second cavity height 125 can be approximately 0.20 inch (in.) (5.08 millimeter (mm)) to approximately 0.28 inch (7.11 mm) in height. In some embodiments, second cavity height 125 can be approximately 0.20 in. (5.08 mm), 0.21 in. (5.33 mm), 0.22 in. (0.588 mm), 0.23 in (5.84 mm), 0.24 in. (6.10 mm), 0.25 in. (6.35 mm), 0.26 in. (6.60 mm), 0.27 in. (6.86 mm), or 0.28 in. (7.11 mm) in height. In some embodiments, second cavity 118 can comprise a second cavity length 430 (shown in FIG. 4). In some embodiments, second cavity length 430 can be approximately 1.7 inches (43.18 mm) to 2.1 inch (53.34 mm) in length. In some embodiments, second cavity length 430 can be approximately 1.7 in. (43.18 mm), 1.8 in. (45.72 mm), 1.9 in. (48.26 mm), 2.0 in. (50.8 mm), 2.1 in. (53.34 mm). In many embodiments, second cavity 118 can also comprise a volume of second cavity 118. In some embodiments, the volume of second cavity 118 can be approximately 0.08 $in^3$ (1310.97 $mm^3$) to approximately 0.10 $in^3$ (1638.71 $mm^3$).

In some embodiments, second cavity 118 can be contoured to follow the shape of rear portion 114. In many embodiments, one or more of the wall(s) of second cavity 118 can at least partially follow the shape of rear portion 114. For example, FIG. 2 shows walls 217, 219, 221, and 223 of second cavity 118 as being substantially parallel to the walls of rear portion 114. In other embodiments, second cavity 118 can only partially follow only one or more wall(s) of rear portion 114 and can have a different shape. For example, second cavity 318 (FIG. 3) can partially follow one or more wall(s) of rear portion 314 and have a trapezoid cross section shape as shown in FIG. 3.

FIG. 3 illustrates a golf club head 300 similar to the golf club head of FIG. 1 along cross-sectional line 2-2 of FIG. 1, according to another embodiment. Golf club head 300 comprises a strikeface 302, a backside 304 of the strikeface, a first cavity 316, and a sole 312. In this embodiment, second cavity walls 317 and 319 substantially follow the walls of rear portion 314, while second cavity walls 321 and 323 partially follow only one or more of the walls of rear portion 114. In other embodiments, second cavity 318 can have a substantially triangular, rectangular, square, or circular cross section. In some embodiments, the cross section of second cavity 318 can change throughout rear portion 314. For example, at the heel region, the cross section of second cavity 318 can be larger in area than the cross section of second cavity 318 at the toe region. In other examples, the cross section of second cavity 318 at the heel region can be smaller in area than the cross section of second cavity 318 at the toe region. Second cavity 318 can be covered by a cap 320.

In some embodiments, returning to FIG. 2, wall(s) 217, 219, 221, and/or 223 surrounding second cavity 118 can be substantially thin. For example, in some embodiments wall (s) 217, 219, 221, and/or 223 can be approximately 0.001 in. (0.00254 mm) to approximately 0.400 in (10.16 mm) in thickness. In some embodiments, wall(s) 217, 219, 221, and/or 223 can be approximately 0.040 in. (1.016 mm) to approximately 0.150 in. (3.81 mm) in thickness. In some embodiments, wall(s) 217, 219, 221, and/or 223 can be approximately 0.040 in. (1.016 mm), 0.06 in. (1.524 mm), 0.08 in. (2.032 mm), 0.10 in. (2.54 mm), 0.12 in. (3.05 mm), 0.14 in. (3.56 mm), or 0.150 in. (3.81 mm) in thickness.

FIG. 4 illustrates another back, toe-side perspective, x-ray view of club head 100 of FIG. 1. In FIG. 4, second cavity 118 is shown as dashed lines within rear portion 114. In some embodiments, second cavity 118 can extend from heel region 106 to toe region 108. In other embodiments, second cavity can extend from the middle of rear portion 114 to toe region 108. In some embodiments, second cavity can extend from the middle of rear portion 114 to heel region 106. In other embodiments, second cavity can be located only at toe region 108. Second cavity 118 can be substantially parallel to strikeface 102. In other embodiments, only one wall of second cavity 118 can be substantially parallel to strikeface 102. In some embodiments, second cavity 118 is not substantially parallel to strikeface 102. In many embodiments, second cavity 118 can be substantially hollow and/or empty. In other embodiments, second cavity 118 can comprise a weight or other filler material.

Figure 6:
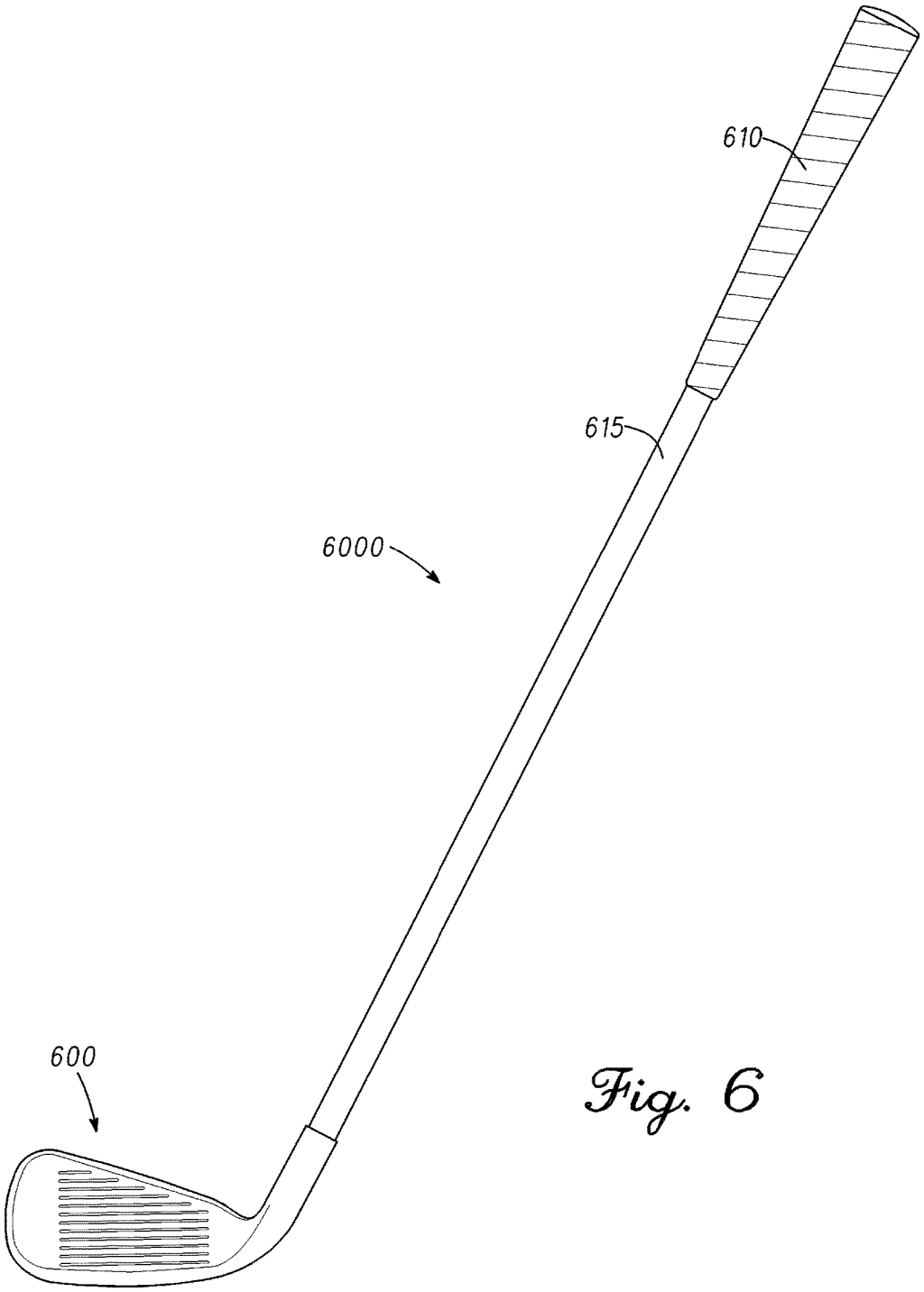
FIG. 6 depicts a front view of a golf club according to an embodiment.

Some embodiments include a fully assembled golf club, such as a golf club 6000 as shown in FIG. 6. FIG. 6 shows a front view of a golf club 6000 according to an embodiment. In some embodiments, golf club 6000 can comprise a shaft 615, a grip 610 at one end of shaft 615, and a golf club head 600 coupled to shaft 615 at an opposite end of shaft 615. In many embodiments, golf club head 600 can be similar to golf club head 100 (FIG. 1), golf club head 300 (FIG. 3), golf club head 700 (FIG. 7), and/or golf club head 900 (FIG. 10). In some embodiments, golf club 6000 is an iron-type golf club. In other embodiments, golf club 6000 can be another type of golf club head (e.g., a driver-type club head, a fairway wood-type club head, a hybrid-type club head, a wood-type club head, a wedge-type club head, or a putter-type club head.)

Figure 11:
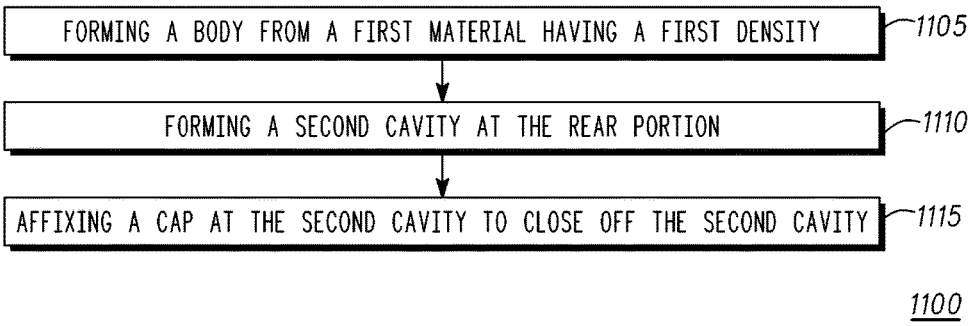
FIG. 11 depicts a method of manufacturing a golf club head according to an embodiment of a method.

Various embodiments include a method 1100 for manufacturing a golf club head as shown in FIG. 11. FIG. 11 depicts a method of manufacturing a golf club head according to an embodiment. In some embodiments, method 1100 can be used to manufacture a golf club head similar to golf club head 100 (FIG. 1), golf club head 300 (FIG. 3), golf club head 700 (FIG. 7), and/or golf club head 900 (FIG. 10).

In many embodiments, method 1100 comprises forming a body from a first material having a first density (block 1105). In some embodiments, forming a body from a first material can comprise forging the body. In other embodiments, forming a body from a first material can comprise casting the body. In some embodiments, method 1100 can comprise manufacturing a golf club head for an iron-type club head. In many embodiments, method 1100 can comprise forming a strikeface, a backside of the strike face, a heel region, a toe region opposite the heel region, a sole, and a first cavity at the backside of the strikeface for the body formed in block 1105.

In many embodiments, method 1100 can further comprise forming a rear portion opposite the strikeface in the body formed in block 1105. In many embodiments, and similar to as described above and shown in FIG. 2, the rear portion can have a rear portion height. In many embodiments, the rear portion height can be measured from the bottom of the rear portion to a maximum height of the rear portion. Additionally, as shown in FIG. 2, strikeface 102 can comprise a strikeface height which can be measured from the bottom of rear portion 114 to the top of strikeface. As shown in FIG. 2, as measured, strikeface height 130 can be substantially parallel to rear portion height 127. In many embodiments, forming the second cavity in block 1110 of method 1100 can comprise forming the rear portion height to be approximately one-fourth to approximately one-half of the strikeface height. In other embodiments, forming the second cavity in block 1110 can comprise forming the rear portion height to be approximately one-half to approximately three-fourths of the strikeface height. In some embodiments, forming the second cavity in block 1110 of method 1100 can comprise forming the rear portion height to be equal to approximately one-half of the strikeface height.

In some embodiments, method 1100 can comprise configuring the first cavity to receive an insert, while in other embodiments first cavity can be configured to be hollow and/or to not receive an insert. For example, method 1100 can comprise forming body 701, as shown in FIG. 7, and configuring first cavity 716 to receive insert 740. In some embodiments, an insert material of insert 740 can be more dense than a body material of body 701. In other embodiments, the insert material of insert 740 can be the same density or less dense than the body material of body 701. In some embodiments, the insert material of insert 740 can be the same as cap 120 (FIG. 1) described above. In some embodiments, a length of the first cavity can be substantially parallel to the strikeface, as shown by first cavity 116 of FIG. 1. In some embodiments, the first cavity can be forward of the rear portion, such as shown in golf club head 100 of FIG. 2.

In many embodiments, method 1100 can also comprise forming a second cavity at the rear portion (block 1110) and affixing a cap at the second cavity to close off the second cavity (block 1115). In some embodiments, block 1110 of forming the second cavity at the rear portion can further comprise removing an inner rear portion material from the rear portion. In many embodiments, the inner rear portion can be removed from an opening in the toe region. In some embodiments, the inner rear portion can be removed from an opening in the sole and/or an opening in the heel. In some embodiments, the second cavity at the rear portion formed in block 1110 can be formed by using a pull piece to create the second cavity. In some embodiments, block 1110 comprises removing approximately 8 g to approximately 30 g of material from the rear portion. In some embodiments, block 1110 comprises removing approximately 10 g to approximately 15 g from the rear portion.

Forming the second cavity in block 1110 can further comprise extending the second cavity from the heel region to the toe region. For example, as shown in FIG. 4, second cavity 118 can be formed to extend from heel region 106 to toe region 108. In other embodiments, forming the second cavity can comprise extending the second cavity from the middle of the rear portion to the toe region. In some embodiments, forming the second cavity can comprise extending the second cavity from the middle of the rear portion to the heel region. In other embodiments, forming the second cavity can comprise forming second cavity at the toe region. In some embodiments, block 1110 of method 1100 can further comprise forming the second cavity to be substantially parallel to the strikeface. For example, as shown in FIG. 4, second cavity 118 can be substantially parallel to strikeface 102. In other embodiments, block 1110 can comprise forming the second cavity wherein only one wall of the second cavity can be substantially parallel to the strikeface. In some embodiments, the second cavity is not formed to be substantially parallel to the strikeface. In many embodiments, block 1110 of method 1100 can comprise forming the second cavity to be hollow and/or empty. In other embodiments, block 1110 method 1100 can comprise forming the second cavity so that the second cavity can comprise a weight and/or other filler material.

In some embodiments, forming the second cavity in block 1110 of method 1100 can comprise forming the second cavity to have a second cavity height. In various embodiments, forming the second cavity in block 1110 can comprise forming the second cavity height to be approximately 0.20 inch (5.08 mm) to approximately 0.28 inch (7.112 mm) in height.

In some embodiments, forming the second cavity in block 1110 of method 1100 can comprise forming a second cavity length, such as second cavity length 430 as shown in FIG. 4, to be approximately 1.7 inch (43.18 mm) to approximately 2.1 inch (53.34 mm) in length. In many embodiments, forming the second cavity in block 1110 of method 1100 can comprise forming the second cavity to have a second cavity volume of approximately 0.08 $in^3$ (1310.97 $mm^3$) to approximately 0.10 $in^3$ (1638.71 $mm^3$). In some embodiments, forming the second cavity in block 1110 can comprise removing approximately 3 g to approximately 30 g from the rear portion. In other embodiments, forming the second cavity in block 110 can comprise removing approximately 3 g to approximately 11 g from the rear portion. In some embodiments, forming the second cavity in block 1110 comprises forming the second cavity to be hollow.

In many embodiments, forming the second cavity in block 1110 comprises forming the second cavity only at the rear portion. For example, second cavity 118 of FIG. 2 can be formed at rear portion 114. In many embodiments, forming the second cavity in block 1110 of method 1100 can comprise contouring the second cavity to follow the shape of the rear portion, such as, in some examples, second cavity 118 of FIG. 2. In other embodiments, forming the second cavity in block 1110 can comprise forming the second cavity to comprise a different cross-sectional shape, such as a trapezoidal shape as shown in second cavity 318 of FIG. 3.

In other embodiments, forming the second cavity in block 1110 can comprise forming the second cavity to comprise a substantially triangular, rectangular, square, or circular cross-section in at least a portion of the second cavity. In some embodiments, the cross-section of the second cavity can change throughout the rear portion. In other embodiments, the cross-section of the second cavity can remain the same throughout the rear portion of the golf club head. For example, the second cavity formed in block 1110 can have a cross-sectional area at the heel region larger than the cross section of the second cavity at the toe region. In other examples, the cross-sectional area of second cavity formed in block 1110 at the heel region can be smaller than the cross-sectional area at the toe region.

In some embodiments, the one or more of the walls surrounding the second cavity (such as wall(s) 217, 219, 221, and/or 223 in FIG. 2) can be formed to be substantially thin. For example, in some embodiments, wall(s) 217, 219, 221, and/or 223 of FIG. 2, can be formed to be approximately 0.001 in. (0.00254 mm) to approximately 0.400 in. (10.16 mm) in thickness. In some embodiments, wall(s) 217, 219, 221, and/or 223 can be formed to be approximately 0.040 in. (1.016 mm) to approximately 0.150 in. (3.81 mm) in thickness. In some embodiments, wall(s) 217, 219, 221, and/or 223 can be approximately 0.040 in. (1.016 mm), 0.06 in. (1.524 mm), 0.08 in. (2.032 mm), 0.10 in. (2.54 mm), 0.12 in. (3.05 mm), 0.14 in. (3.56 mm), or 0.150 in. (3.81 mm) in thickness.

In some embodiments, method 1100 can further comprise affixing a cap at the second cavity to close off the second cavity (block 1115). In many embodiments, affixing the cap at the second cavity comprises affixing the cap at least partially at the toe region of the golf club head. For example, FIG. 1 shows cap 120 affixed at least partially at toe region 108 of golf club head 100. In other embodiments, affixing the cap at the second region can comprise affixing the cap at least partially at the sole of the golf club head, at least partially at the toe region, and/or at least partially at the heel region of the golf club head. In some embodiments, affixing the cap at the second region can comprise affixing the cap at least partially at the rear portion. In some embodiments, the cap 120 can weigh approximately 3 g to approximately 30 g. In some embodiments, the cap 120 can weigh approximately 3 g to approximately 25 g. In some embodiments, the cap 120 can weigh approximately 3 g, 5 g, 7 g, 9 g, 11 g, 13 g, 15 g, 17 g, 19 g, 21 g, 23 g, or 25 g.

In many embodiments, the cap comprises a cap density of the cap that is higher that a club head density of the body. In other embodiments, the cap comprises a cap density of the cap that is the same or lower than the club head density of the body. In some embodiments, the cap can comprise tungsten. In some embodiments, the cap can comprise steel. In many embodiments, cap 120 can be affixed so that it is substantially flush with the body of the golf club head. For example, as shown in FIG. 1, cap 120 is substantially flush with body 101 of golf club head 100. In other embodiments, the cap can at least partially protrude from the body.

Figure 12:
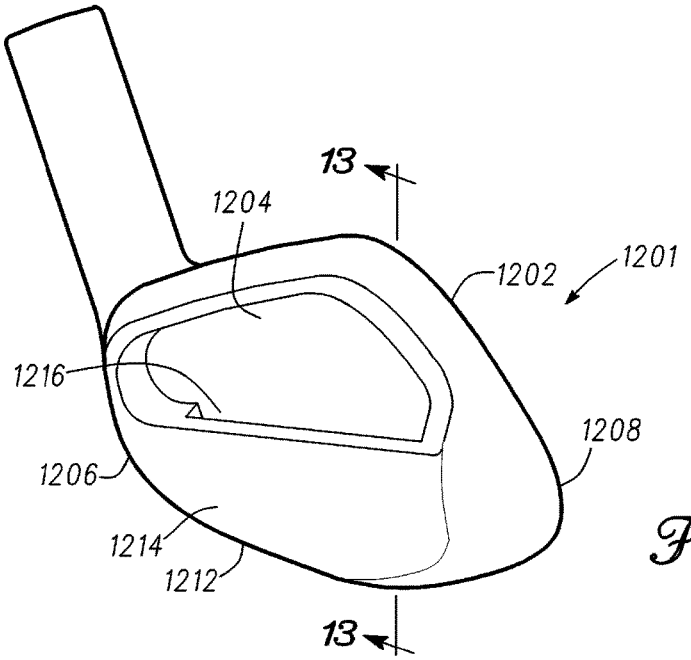
FIG. 12 depicts a back, toe-side perspective view of a golf club head according to an embodiment.
Figure 17:
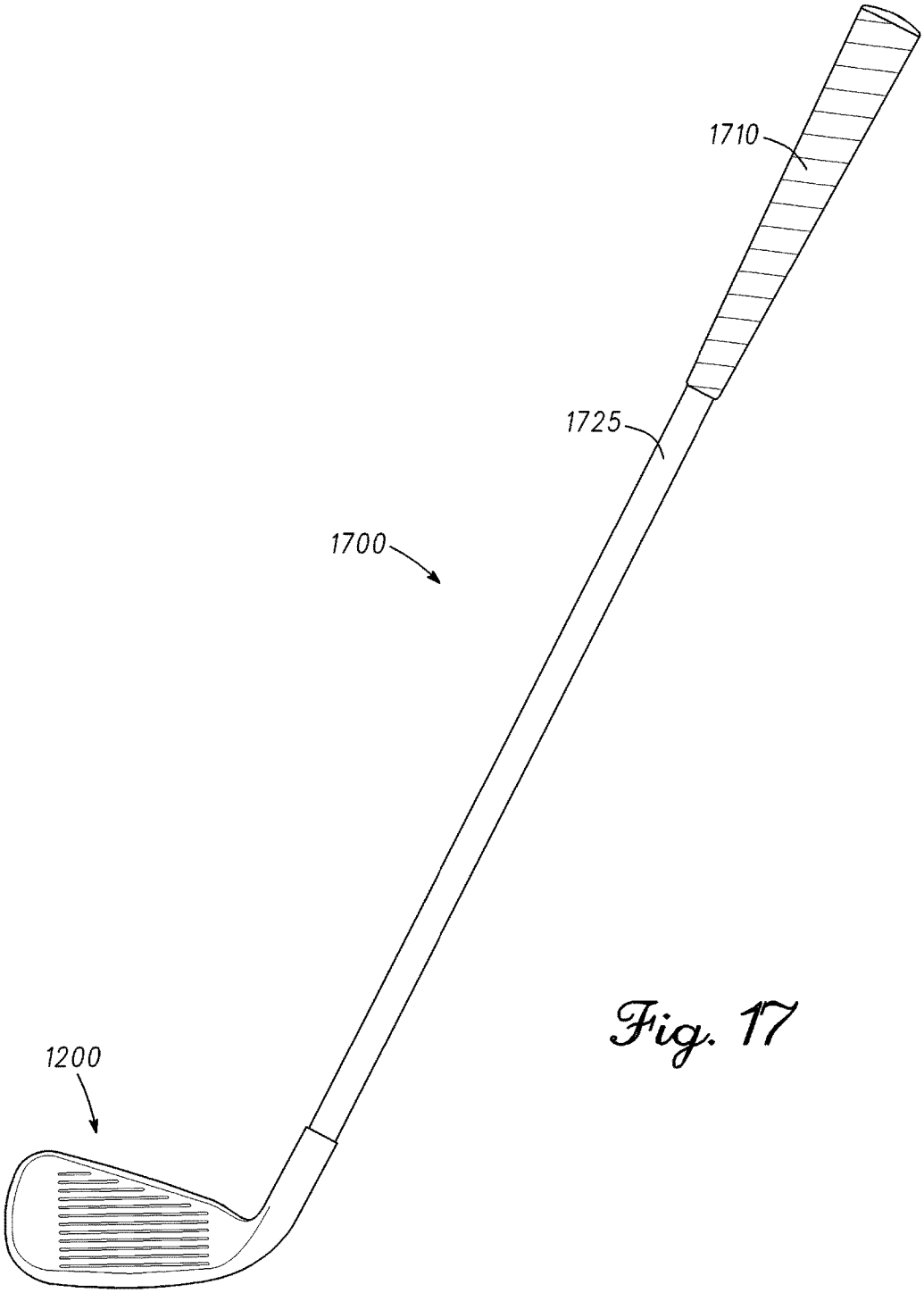
FIG. 17 depicts a front view of a golf club according to an embodiment.

FIG. 12 depicts another embodiment of a golf club head with cavities. FIG. 12 illustrates a back, toe-side perspective view of a golf club head 1200 according to an embodiment. Golf club head 1200 is merely exemplary and is not limited to the embodiments presented herein. Golf club head 1200 can be employed in many different embodiments or examples not specifically depicted or described herein. FIG. 17 illustrates a golf club 1700 comprising golf club head 1200, shaft 1725, and grip 1710. In many embodiments, golf club head 1200 can be coupled to shaft 1725, and shaft 1725 can be coupled to grip 1710.

Figure 13:
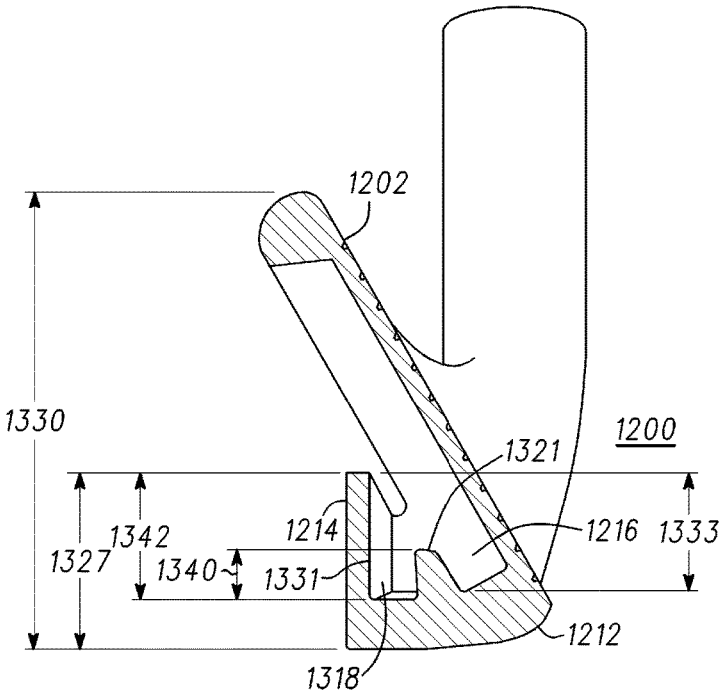
FIG. 13 depicts a golf club head similar to the golf club head of FIG. 12 along the cross-sectional line 13-13 in FIG. 12, according to another embodiment.

Returning to FIG. 12, in some embodiments, golf club head 1200 can be an iron-type golf club head. In other embodiments, golf club head 1200 can be another type of golf club head (e.g., a driver-type club head, a fairway wood-type club head, a hybrid-type club head, a wood-type club head, a wedge-type club head, or a putter-type club head.) In some embodiments, golf club head 1200 comprises a body 1201. In many embodiments, body 1201 comprises a strikeface 1202, a backside 1204 of strikeface 1202, a heel region 1206, a toe region 1208 opposite heel region 1206, and a sole 1212 at the bottom of body 1201. Body 1201 can further comprise a rear portion 1214 opposite strikeface 1202. In many embodiments, body 1201 can further comprise a first cavity 1216 at backside 1204. In some embodiments, first cavity 1216 can be located between strikeface 1202 and rear portion 1214. In many embodiments, first cavity 1216 can extend from the heel region 1206 to toe region 1208. As shown in FIG. 13, strikeface 1202 can have a strikeface height 1330. Strikeface height 1330 can be measured from the bottom of sole 1212 to the top of strikeface 1202 in a direction substantially perpendicular to ground when golf club head 1200 is at address. As measured, strikeface height 1330 can be substantially parallel to a rear portion height 1327. Rear portion height 1327 is measured from the bottom of sole 1212 to the top of rear portion 1214. In many embodiments, rear portion height 1327 can be approximately one-fourth to approximately one-half of strikeface height 1330. In other embodiments, rear portion height 1327 can be approximately one-half to approximately three-fourths of strikeface height 1330. In some embodiments, rear portion height 1327 can be equal to approximately one-half of strikeface height 1330.

In some embodiments, first cavity 1216 can comprise a first cavity height 1333. First cavity height 1333 can be measured perpendicular to the ground when golf club head 1200 is at the address position from the lowest point of first cavity 1216 to the top of rear portion 1214. In some embodiments, first cavity height 1333 is greater at a middle of first cavity 1216 than at either heel region 1206 (FIG. 12) of first cavity 1216 or toe region 1208 (FIG. 12) of first cavity 1216. In many embodiments, first cavity height 1333 can be approximately 0.25 inch (6.35 mm) to 0.59 inch (14.99 mm). In many embodiments, first cavity height 1333 can be approximately 0.35 inch (8.89 mm) to 0.49 inch (12.45 mm). In some embodiments, first cavity height 1333 can be approximately 0.3 inch (7.62 mm), 0.4 inch (10.16 mm), or 0.50 inch (12.7 mm).

In some embodiments, first cavity 1216 can have a first cavity length 1680 (FIG. 16) measured substantially perpendicularly to strikeface height 1330. In many embodiments, first cavity length 1680 (FIG. 16) can be approximately 1.5 inch (38.1 mm) to 2.7 inch (68.58 mm). In many embodiments, first cavity length 1680 can be approximately 1.5 in. (38.1 mm), 1.6 in. (40.6 mm), 1.7 in. (43.2 mm), 1.8 in. (45.7 mm), 1.9 in. (48.3 mm), 2.0 in. (50.8 mm), 2.1 in. (53.3 mm), 2.2 in. (53.9 mm), 2.3 in. (58.4 mm), 2.4 in. (61.0 mm), 2.5 in. (63.5 mm), 2.6 in. (66.0 mm), or 2.7 in. (68.6 mm). In some embodiments, first cavity length 1680 (FIG. 16) can be approximately 2.1 inch (53.34 mm). In many embodiments, first cavity 1216 can have a volume of approximately 0.1 $inch^3$ (1638.7 $mm^3$) to approximately 0.2 $inch^3$ (3277.4 $mm^3$). In some embodiments, first cavity 1216 can have a volume of approximately 0.15 $inch^3$ (2458.1 $mm^3$). In many embodiments, first cavity 1216 can reduce the weight of golf club head 1200 by approximately 14 grams, 15 grams, 16 grams, 17 grams, 18 grams, 19 grams or 20 grams.

In some embodiments, golf club head 1200 can comprise a hosel, which in other embodiments can be omitted. Similar to rear portion 114 (FIG. 1), rear portion 1214 can be designed to look similar to a traditional muscleback iron golf club head. For example, many muscleback irons have a full back or full rear portion of a golf club head. Muscleback irons differ from non-muscleback irons in which the rear or back of the golf club head has been hollowed out to at least partially remove the muscleback, full back and/or rear portion. In some embodiments, rear portion 1214 can be designed to provide a heavy or thick look to the golf club head. For users who prefer the heavy look to a golf club head, but would like an enhanced weight distribution, higher moment of inertia and/or a lower center of gravity, a second cavity within the rear portion or muscleback portion of the golf club head can be designed. In some instances, the higher moment of inertia can provide more forgiveness.

In some embodiments, the higher moment of inertia can be at least partially due to perimeter weighting. In other embodiments, the higher moment of inertia can be at least partially due to a second cavity in body 1201. Turning to FIG. 13, in many embodiments, body 1201 further comprises a second cavity 1318 at or within rear portion 1214. FIG. 13 illustrates golf club head 1200 of FIG. 12 along the cross-sectional line 13-13 of FIG. 12. In some embodiments, second cavity 1318 can be designed to enhance weight distribution of golf club head 1200, while maintaining a heavy or muscleback look of rear portion 1214. In some embodiments, second cavity 1318 can be hollow, thereby reducing the mass and/or weight of rear portion 1214. In other embodiments, second cavity 1318 can be at least partially hollow. In other embodiments, second cavity 1318 can comprise a filler material in all or a portion of second cavity 1318. In embodiments wherein second cavity 1318 comprises the filler material, the filler material can be less dense than the material(s) used for other parts of body 1201 (i.e., the club head density). In many embodiments, at least a portion of first cavity 1216 can be located between strikeface 1202 and second cavity 1318.

In some embodiments, second cavity 1318 can extend from heel region 1206 (FIG. 12) to toe region 1208 (FIG. 12). In various embodiments, first cavity 1216 and second cavity 1318 can be directly coupled to each other to form a single, aggregate cavity. In some embodiments, first cavity 1216 and second cavity 1318 can be coupled together at a top of rear portion 1214. In other embodiments, first cavity 1216 and second cavity 1318 can be coupled together at a portion of the top of rear portion 1214.

In many embodiments, rear portion 1214 can comprise a middle wall 1321. In some embodiments, middle wall 1321 can at least partially separate first cavity 1216 from second cavity 1318. Middle wall 1321 can comprise a middle wall height 1340 measured substantially parallel to strike face height 1330. In many embodiments, middle wall height 1340 can be approximately 0.060 inch (1.52 mm) to approximately 0.312 inch (7.92 mm). In some embodiments, middle wall height 1340 can be approximately 0.1 inch (2.54 mm), 0.2 inch (5.08 mm), or 0.3 inch (7.62 mm). In some embodiments, middle wall 1321 can extend from heel region 1206 to toe region 1208. In other embodiments, middle wall 1321 can extend from a middle of second cavity 1318 to heel region 1206 (FIG. 12) or toe region 1208 (FIG. 12). In some embodiments, middle wall height 1340 is approximately constant throughout middle wall 1321. In other embodiments, middle wall height 1340 varies throughout middle wall 1321. For example, middle wall height 1340 can increase from heel region 1206 (FIG. 12) to toe region 1208 (FIG. 12). For example, at the center of second cavity 1318, middle wall height 1340 can be approximately 0.208 inch (5.28 mm) while at least one of heel region 1206 (FIG. 12) or toe region 1208 (FIG. 12) of second cavity 1318, middle wall height 1340 can be approximately 0.12 inch (3.05 mm).

In some embodiments, rear portion 1214 and second cavity 1318 can comprise a back wall 1331. In some embodiments, second cavity 1318 can comprise a second cavity height 1342, which can be measured substantially parallel to strikeface height 1330 and which can be approximately equal to the height of back wall 1331. In some embodiments, second cavity height 1342 is approximately the same height as rear portion 1214. In some embodiments, second cavity height 1342 can vary across a length of second cavity 1318. For example, at the center of second cavity 1318, second cavity height 1342 can be approximately 0.464 inch (11.79 mm) while at least one of heel region 1206 (FIG. 12) or toe region 1208 (FIG. 12) of second cavity 1318, back wall height can be approximately 0.380 inch (9.65 mm). In some embodiments, second height 1342 can be approximately 0.28 inch (7.11 mm) to approximately 0.56 inch (14.22 mm). In some embodiments, back wall height 1342 can be approximately 0.3 inch (7.62 mm), 0.4 inch (10.16 mm), or 0.5 inch (12.7 mm). In some embodiments, second cavity height 1342 can be approximately 0.38 inch (9.65 mm) to approximately 0.46 inch (11.68 mm).

In some embodiments, second cavity 1318 can have a second cavity length (not shown) measured substantially perpendicularly to strikeface height 1330. In many embodiments, the second cavity length can be approximately 1.4 inch (35.56 mm) to 2.6 inch (66.04 mm). In many embodiments, the second cavity length can be approximately 1.4 in. (35.6 mm), 1.5 in. (38.1 mm), 1.6 in. (40.6 mm), 1.7 in. (43.2 mm), 1.8 in. (45.7 mm), 1.9 in. (48.3 mm), 2.0 in. (50.8 mm), 2.1 in. (53.3 mm), 2.2 in. (53.9 mm), 2.3 in. (58.4 mm), 2.4 in. (61.0 mm), 2.5 in. (63.5 mm), or 2.6 in. (66.0 mm). In some embodiments, the first cavity length can be approximately 2.0 inch (50.8 mm). In many embodiments, second cavity 1318 can have a volume of approximately 0.07 $inch^3$ (1147.1 $mm^3$) to approximately 0.17 $inch^3$ (2785.8 $mm^3$). In some embodiments, first cavity 1216 can have a volume of approximately 0.12 $inch^3$ (1966.45 $mm^3$). In many embodiments, second cavity 1318 can reduce the weight of golf club head 1200 by approximately 15 grams. In some embodiments, first cavity 1216 can be larger than second cavity 1318. In other embodiments, second cavity 1318 can be larger than first cavity 1216. In other embodiments, second cavity 1318 can be approximately equal in volume to first cavity 1216.

Returning to FIG. 12, in some embodiments, first cavity 1216 can be substantially parallel to strikeface 1202. In some embodiments, first cavity 1216 can be forward of rear portion 1214, as shown in FIG. 13. In some embodiments, second cavity 1318 can be substantially parallel to strikeface 1202.

Figure 14:
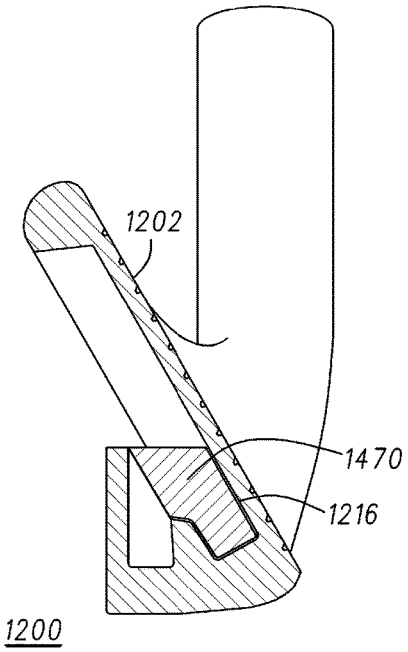
FIG. 14 depicts a golf club head similar to the golf club head of FIG. 12 along the cross-sectional line 13-13 in FIG. 12, according to another embodiment.

In some embodiments, first cavity 1216 can be configured to receive an insert. For example, FIG. 14 illustrates a first insert 1470. FIG. 14 shows an embodiment of golf club head 1200 along the cross-sectional line 13-13 of golf club head 1200 in FIG. 12. In many embodiments, golf club head 1200 can further comprise first insert 1470 at least partially within first cavity 1216. In some embodiments, first insert 1470 can fill a center of first cavity 1216. In the same or different embodiments, first insert 1470 can fill heel region 1206 (FIG. 12) and/or toe region 1208 (FIG. 12) of first cavity 1216. In some embodiments, first insert 1470 is not at heel region 1206 (FIG. 12) and/or toe region 1208 (FIG. 12) of first cavity 1216. In many embodiments, first insert 1470 covers the top of second cavity 1318 and the top of first cavity 1216. In some embodiments, first insert 1470 comprises a first insert height that is greater than first cavity height 1333 (FIG. 13). In some embodiments, the first insert height is approximately equal to first cavity height 1333 (FIG. 13). In other embodiments, at least a portion of the first insert height is less than first cavity height 1333 (FIG. 13). In many embodiments, when first insert 1470 can dampen a portion of the vibrations from the impact of a golf ball (not shown) on strikeface 1202, which can allow for a solid feel on impact with the golf ball.

In some embodiments, first insert 1470 can comprise a custom tuning port weight and/or a filler insert. In some embodiments, first insert 1470 can comprise a plastic such as polyurethane, thermoplastic polyurethane, and/or thiacarbosilane (Sis/Poly). In many embodiments, any of these plastics can be mixed with stainless steel, glass, and/or tungsten powder to increase the specific target weight of first insert 1470. In many embodiments, first insert 1470 can comprise polyurethane, polyurethane and glass powder, polyurethane and tungsten powder, polyurethane and stainless steel powder, thermoplastic polyurethane, thermoplastic polyurethane and glass powder, thermoplastic polyurethane and stainless steel powder, thermoplastic polyurethane and tungsten powder, Sis/Poly, Sis/Poly and glass powder, Sis/Poly and tungsten powder, and/or Sis/Poly and stainless steel powder. In some embodiments, an insert material of the first insert 1470 may be the same material as the material of the cap 120 (FIG. 1) discussed above. In some embodiments, an insert material of first insert 1470 can be more dense than a body material of body 1201 (FIG. 12). In other embodiments, the insert material of first insert 1470 can be the same density or less dense than the golf club head material density of body 1201 (FIG. 12). In some embodiments, the density of first insert 1470 can change throughout first insert 1470.

In some embodiments, second cavity 1318 can be configured to receive an insert.

Figure 15:
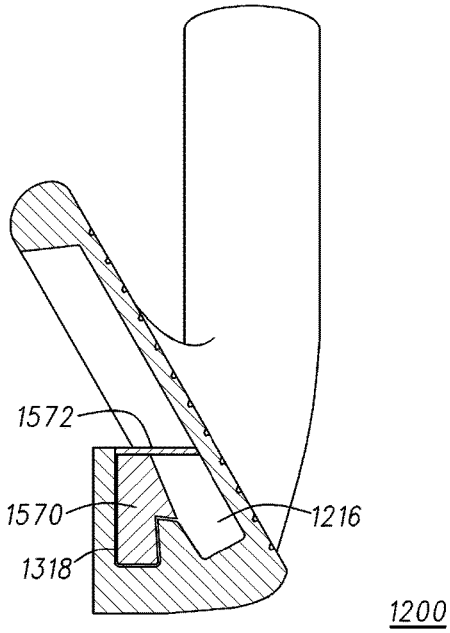
FIG. 15 depicts a golf club head similar to the golf club head of FIG. 12 along the cross-sectional line 13-13 in FIG. 12, according to another embodiment.

For example, FIG. 15 illustrates a second insert 1570. FIG. 15 shows an embodiment of golf club head 1200 along the cross-sectional line 13-13 of golf club head 1200 in FIG. 12. In many embodiments, golf club head 1200 can further comprise second insert 1570 at least partially within second cavity 1318. In some embodiments, second insert 1570 can fill a center of second cavity 1318. In the same or different embodiments, second insert 1570 can fill heel region 1206 (FIG. 12) and/or toe region 1208 (FIG. 12) of second cavity 1318. In some embodiments, second insert 1570 is not at heel region 1206 (FIG. 12) and/or toe region 1208 (FIG. 12) of second cavity 1318. In some embodiments, second insert 1570 comprises a second insert height that is greater than second cavity height 1342 (FIG. 13). In some embodiments, the second insert height is approximately equal to second cavity height 1342 (FIG. 13). In other embodiments, at least a portion of the second insert height is less than second cavity height 1342 (FIG. 13).

In some embodiments, second insert 1570 can comprise a custom tuning port weight and/or a filler insert similar to first insert 1470 (FIG. 14) or cap 120 (FIG. 1). In some embodiments, an insert material of second insert 1570 can be more dense than a body material of body 1201 (FIG. 12). In other embodiments, the insert material of second insert 1570 can be the same density or less dense than the golf club head material density of body 1201 (FIG. 12). In many embodiments, second insert 1570 covers the top of second cavity 1318 and the top of first cavity 1216. In some embodiments, when second cavity 1318 receives second insert 1570, the moment of inertia of golf club head 1200 can be increased compared to when first cavity 1216 receives first insert 1470 (FIG. 14), thereby further increasing the forgiveness of the golf club head.

In some embodiments, at least one vibration attenuating feature (e.g., first insert 1470 (FIG. 14) can be disposed in either or both of first cavity 1216 (FIG. 13) and second cavity 1318 (FIG. 13) golf club head 1200. The vibration attenuating feature can produce a more desirable sound from golf club head 1200 upon impact. In some embodiments, strikeface 1202 (FIG. 12) of golf club head 1200 can cause undesirable sounds when striking a golf ball. The vibration attenuating feature can reduce the vibrations leading to a more desirable sound on impact by strikeface 1202 (FIG. 12). By providing a more desirable noise, the vibration attenuating component can increase a user's confidence during use. The vibration attenuating feature also can reduce the vibrational shock felt by the user of the golf club upon striking the golf ball. Furthermore, the vibration attenuating feature may reduce vibrational fatigue to decrease wear on golf club 1200 and various features such as, but not limited to, first cavity 1216 (FIG. 12) or second cavity 1318 (FIG. 13). The reduced vibrational fatigue can further lower the risk of loosening or displacement of parts such as, but not limited to, first insert 1470 (FIG. 14) of first cavity 1216 (FIG. 12) or second insert 1570 (FIG. 15) in second cavity 1318 (FIG. 13). The reduced vibrational fatigue may extend the performance life of golf club head 1200.

Figure 19:
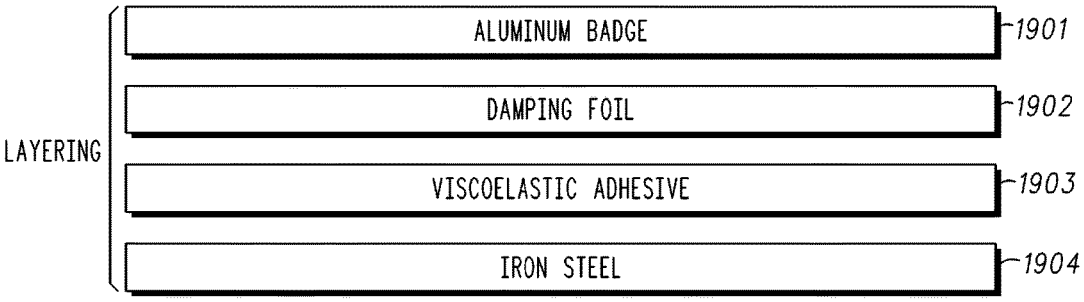
FIG. 19 depicts a diagram for an embodiment of the layers of a vibration attenuating feature.

As seen in FIG. 19, in further embodiments, the vibration attenuating feature may comprise at least one layer of a viscoelastic damping material. The damping material may comprise a pressure sensitive viscoelastic acrylic polymer and aluminum foil forming a damping foil 1902 such as 3M™ Damping Foil Tape 2552. The damping foil 1902 may comprise an adhesive layer. In one embodiment the vibration attenuating feature may comprise at least one viscoelastic adhesive layer 1903 which may comprise a composition of varying layers of at least one layer of epoxy adhesive, a viscoelastic foam tape, and/or a high strength tape such as 3M™ VHB™ tape. In some embodiments, the vibration attenuating feature may comprise various layer combinations of at least one of viscoelastic adhesive 1903, damping foil 1902, and/or a badge 1901.

Returning to FIG. 14, in some embodiments, the vibration attenuating feature can be disposed on first cavity 1216 of the golf club head, such as golf club head 1200, which comprises a rear surface material such as iron steel 1904. In another embodiment, the vibration attenuating feature can be disposed in second cavity 1318 (FIG. 13), or on or under insert 1470 of the golf club head 1200. The vibration attenuating feature can be located in various locations of first cavity 1216 of the golf club head 1200. Generally, the vibration attenuating feature is at least partially located under the profile of the badge on first cavity 1216. In some embodiments, the vibration attenuating feature is disposed under the entirety of the badge profile. In other embodiments, the vibration attenuating feature is at least partially disposed under only particular regions of the badge profile such as the aluminum or elastomer regions. The vibration attenuating feature can be disposed under only at least part of the perimeter region of the badge profile. In some embodiments the vibration attenuating feature can be disposed at least partially in first cavity 1216 of the golf club head 1200. The vibration attenuating feature may be disposed at least partially on or under first insert 1470 within first cavity 1216 or on or under second insert 1570 (FIG. 15) within second cavity 1318. In some embodiments, the vibration attenuating feature will be disposed such that it covers at least 10 percent of the surface area of first cavity 1216 or second cavity 1318. In other embodiments, the vibration attenuating feature may cover at least 15, 20, 25, 30, 35, 40, 45, 50, 55, 60, 65, 70, 75, 80, 85, 90, 95, or 100 percent of the surface area of first cavity 1216 or second cavity 1318.

Figure 16:
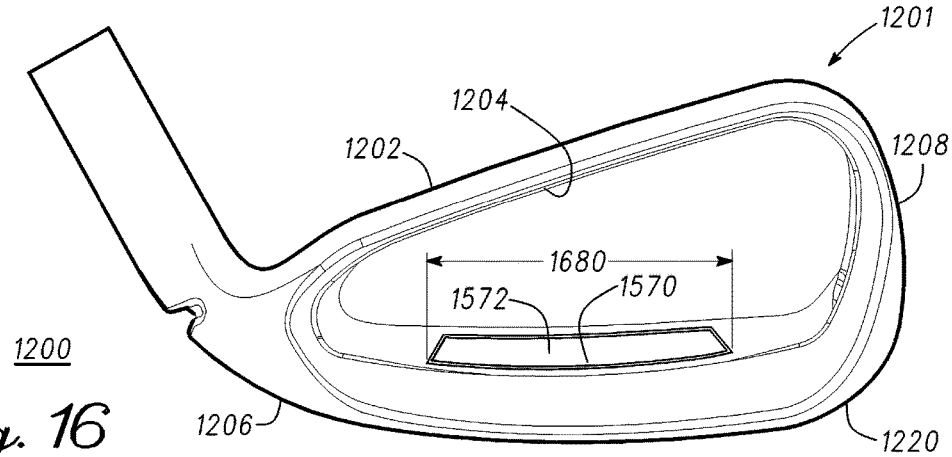
FIG. 16 depicts a back, toe-side perspective view of a golf club head similar to the golf club head of FIG. 15, according to an embodiment.

FIG. 16 depicts a back, toe-side view of golf club head 1200 of FIG. 15. In some embodiments, golf club head 1200 can further comprise a cover 1572 over second insert 1570. In many embodiments, cover 1572 is separate from second insert 1570. In some embodiments, second insert 1570 is not visible when cover 1572 is in place. In many embodiments, cover 1572 can comprise a metal cover piece. In many embodiments, cover 1572 can be used to create an all metal muscleback look. In many embodiments, cover 1572 can be approximately 0.025 inch (0.635 mm) to 0.39 inch (9.91 mm) thick. In some embodiments, cover 1572 can be approximately 0.130 inch (3.3 mm) to approximately 0.25 inch (6.35 mm) In some embodiments, cover 1572 can be approximately 0.1 inch (2.54 mm), 0.2 inch (5.08 mm), or 0.3 inch (7.62 mm) thick.

In some embodiments, first cavity 1216 (FIG. 12) and second cavity 1318 (FIG. 13) can be configured to receive a single insert in at least a portion of both first cavity 1216 (FIG. 12) and second cavity 1318 (FIG. 13). In some embodiments, the single insert can be located at toe region 1208 (FIG. 12) of both first cavity 1216 (FIG. 12) and second cavity 1318 (FIG. 13). In other embodiments, the single insert can be located at heel region 1206 (FIG. 12) of both first cavity 1216 (FIG. 12) and second cavity 1318 (FIG. 13). In other embodiments, the single insert can fill the entirety first cavity 1216 (FIG. 12) and second cavity 1318 (FIG. 13). In some embodiments, the single insert can comprise a custom tuning port weight and/or a filler insert similar to first insert 1470 (FIG. 14) and/or second insert 1570 (FIG. 15) and/or cap 120 (FIG. 1). In some embodiments, an insert material of the single insert can be more dense than a body material of body 1201 (FIG. 12). In other embodiments, the insert material of the single insert can be the same density or less dense than the golf club head material density of body 1201 (FIG. 12). In some embodiments, golf club head 1200 can further comprise a cover similar to cover 1572 (FIG. 15) over the single insert. In many embodiments, first insert 1470 (FIG. 14), second insert 1570 (FIG. 15), and the single insert can dampen a portion of the vibrations from the impact of a golf ball (not shown) against strikeface 1202. This can allow for a solid feel on impact with the golf ball.

Figure 18:
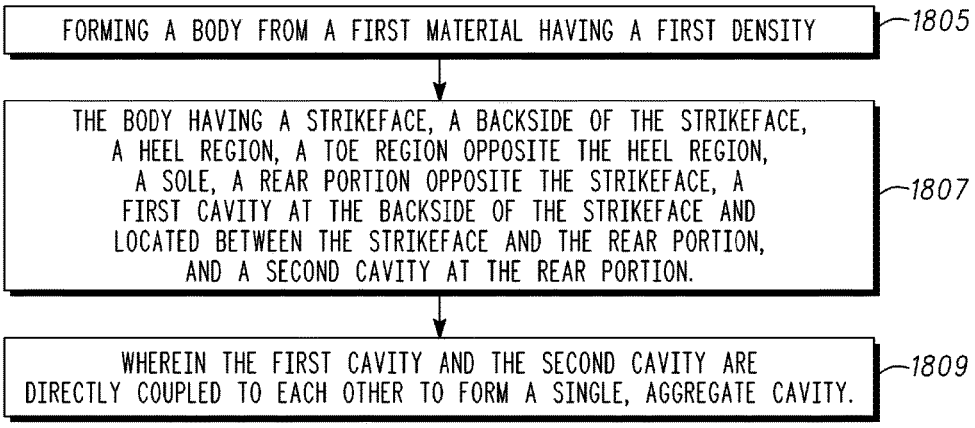
FIG. 18 depicts a method of manufacturing a golf club head according to an embodiment of a method.

Various embodiments include a method 1800 for manufacturing a golf club head as shown in FIG. 18. FIG. 18 depicts a method of manufacturing a golf club head according to an embodiment. In some embodiments, method 1800 can be used to manufacture a golf club head similar to golf club head 1200 (FIG. 12), such as an iron-type golf club head.

In many embodiments, method 1800 can comprise an activity 1805 of forming a body from a first material having a first density. In some embodiments, activity 1805 can comprise activity 1807 of forming the body to have a strikeface, a backside of the strikeface, a heel region, a toe region opposite the heel region, a sole, and a rear portion opposite the strikeface. In many embodiments, activity 1807 also can comprise forming a first cavity at the backside of the strikeface and located between the strikeface and the rear portion and forming a second cavity at the rear portion. In many embodiments, activity 1805 can comprise activity 1809 of forming the first cavity and the second cavity to be directly coupled to each other to form a single, aggregate cavity. In some embodiments, the first cavity and the second cavity are coupled at a top of the rear portion.

In many embodiments, at least a portion of the first cavity can be located between the strikeface and the second cavity. In some embodiments, the first cavity can extend from the heel region to the toe region. The first cavity can comprises a first cavity height. In some embodiments, the first cavity height can greater at a middle of the first cavity that at least one of a heel end of the first cavity and/or a toe end of the first cavity.

In various embodiments, the second cavity can extend from the heel region to the toe region. The second cavity comprises a second cavity height. In some embodiments, the second cavity height is greater at a middle of the second cavity than at least one of a heel end of the second cavity and/or a toe end of the second cavity.

In some embodiments, the first cavity can be configured to receive a first insert. In other embodiments, the second cavity can be configured to receive a second insert. In other embodiments, the first cavity and the second cavity can be configured to receive a single insert in at least a portion of both the first cavity and the second cavity. In many embodiments, method 1800 can further comprise providing a metal cover over the first cavity and/or the second cavity.

In many embodiments, method 1800 can form the rear portion to comprise a middle wall at least partially separating the first cavity from the second cavity. In some embodiments, the middle wall can comprise a middle wall height of approximately 0.060 inch (1.52 mm) to approximately 0.312 inch (7.92 mm). In some embodiments, the middle wall can comprise a middle wall height of approximately 0.06 in. (1.52 mm), 0.10 in. (2.5 mm), 0.15 in. (3.8 mm), 0.20 in. (5.1 mm), 0.25 in. (6.4 mm), 0.30 in. (7.6 mm), or 0.35 in. (8.9 mm). In some embodiments, the middle wall can extend from the heel to the toe. In many embodiments, the middle wall height varies from the heel to the toe.

The golf club heads with cavities and related methods discussed herein may be implemented in a variety of embodiments, and the foregoing discussion of these embodiments does not necessarily represent a complete description of all possible embodiments. Rather, the detailed description of the drawings, and the drawings themselves, disclose at least one preferred embodiment of systems and methods for fitting golf club head weight, and may disclose alternative embodiments of golf club heads with cavities and related methods.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. A golf club head comprising:
a body comprising:
a strikeface;
a backside of the strikeface;
a heel region;
a toe region opposite the heel region;
a sole;
a rear portion opposite the strikeface;
a first cavity at the backside of the strikeface and located between the strikeface and the rear portion; and
a second cavity at the rear portion;
wherein:
the first cavity comprises a first cavity height measured perpendicular to the ground when the golf club head is at an address position from a lowest point of the first cavity to a top of the rear portion; and:
wherein the first cavity height is between 0.25 inch and 0.59 inch;
wherein the second cavity comprises a second cavity height
and
a first insert, or in the alternative, a second insert;
wherein the first insert is positioned within the first cavity or alternatively, the second insert is positioned in the second cavity;
if the first insert is positioned within the first cavity, the first insert encloses a void within the second cavity and does not fully fill the second cavity;
if the second insert is positioned within the second cavity, the second insert encloses a void within the first cavity and does not fully fill the first cavity; and
the rear portion comprises a middle wall located directly between and at least partially separating the first cavity from the second cavity;
wherein the middle wall comprises a middle wall height;
wherein the middle wall height is less than the first cavity height;
wherein the middle wall height is greater than 0.060 inch.

2. The golf club head of claim 1, wherein: the first cavity and the second cavity are coupled together at a top of the rear portion.

3. The golf club head of claim 1, further comprising: a metal cover over the first cavity and the second cavity.

4. The golf club head of claim 1, wherein: at least a portion of the first cavity is located between the strikeface and the second cavity.

5. A golf club comprising:
a shaft;
a grip coupled to the shaft; and
a golf club head coupled to the shaft and comprising:
a body comprising:
a strikeface;
a backside of the strikeface;
a heel region;
a toe region opposite the heel region;
a sole;
a rear portion opposite the strikeface;
a first cavity at the backside of the strikeface and located between the strikeface and the rear portion; and
a second cavity at the rear portion; and
wherein:
the first cavity comprises a first cavity height measured perpendicular to the ground when the golf club head is at an address position from a lowest point of the first cavity to a top of the rear portion; and:
wherein the first cavity height is between 0.25 inch and 0.59 inch;
wherein the second cavity comprises a second cavity height
and
a first insert, or in the alternative, a second insert;
wherein the first insert is positioned within the first cavity or alternatively, the second insert is positioned in the second cavity;
if the first insert is positioned within the first cavity, the first insert encloses a void within the second cavity and does not fully fill the second cavity;
if the second insert is positioned within the second cavity, the second insert encloses a void within the first cavity and does not fully fill the first cavity; and
the rear portion comprises a middle wall located directly between and at least partially separating the first cavity from the second cavity;
wherein the middle wall comprises a middle wall height;
wherein the middle wall height is less than the first cavity height;
wherein the middle wall height is greater than 0.060 inch.

6. The golf club of claim 5, wherein: the first cavity and the second cavity are coupled together at a top of the rear portion.

7. The golf club of claim 5, further comprising: a metal cover over the first cavity and the second cavity.

8. The golf club of claim 5, wherein: at least a portion of the first cavity is located between the strikeface and the second cavity.

9. A method for manufacturing a golf club head, comprising:
forming a body from a first material having a first density, the body having:
a strikeface;
a backside of the strikeface;
a heel region;
a toe region opposite the heel region;
a sole; a rear portion opposite the strikeface;
a first cavity at the backside of the strikeface and located between the strikeface and the rear portion; and
a second cavity at the rear portion; and
wherein:
the first cavity comprises a first cavity height measured perpendicular to the ground when the golf club head is at an address position from a lowest point of the first cavity to a top of the rear portion; and;
wherein the first cavity height is between 0.25 inch and 0.59 inch;
wherein the second cavity comprises a second cavity height
forming the body from the first material having the first density comprises forming the body at least in part by at least one of: casting; or forging;
providing a first insert, or in the alternative, a second insert;
wherein the first insert is positioned within the first cavity or alternatively, the second insert is positioned in the second cavity;
if the first insert is positioned within the first cavity, the first insert encloses a void within the second cavity and does not fully fill the second cavity;

if the second insert is positioned within the second cavity, the second insert encloses a void within the first cavity and does not fully fill the first cavity; and the rear portion comprises a middle wall located directly between and at least partially separating the first cavity from the second cavity;

wherein the middle wall comprises a middle wall height;

wherein the middle wall height is less than the first cavity height;

wherein the middle wall height is greater than 0.060 inch.

10. The method of claim 9, wherein: the first cavity and the second cavity are coupled together at a top of the rear portion.

11. The method of claim 9, further comprising: providing a metal cover over the first cavity and the second cavity.

12. The method of claim 9, wherein: at least a portion of the first cavity is located between the strikeface and the second cavity.

13. The golf club head of claim 1, wherein: the first cavity comprises a first cavity length measured from the heel region to the toe region; and the first cavity length is approximately 1.5 inches (38.1 mm) to approximately 2.7 inches (68.58 mm).

14. The golf club head of claim 1, wherein:

the second cavity comprises a back wall at the rear portion of the golf club head;

the back wall comprises the second cavity height measured perpendicular to the ground when the golf club head is at an address position from a lowest point of the second cavity to the top of the rear portion; and the second cavity height is approximately 0.28 inch (7.11 mm) to approximately 0.56 inch (14.22 mm).

15. The golf club head of claim 1, wherein:

the second cavity comprises a second cavity length measured from the heel region to the toe region; and the second cavity length is approximately 1.4 inches (35.56 mm) to approximately 2.6 inches (66.04 mm).

16. The golf club of claim 5, wherein:

the first cavity comprises a first cavity length measured from the heel region to the toe region; and the first cavity length is approximately 1.5 inches (38.1 mm) to approximately 2.7 inches (68.58 mm).

17. The golf club of claim 5, wherein:

the second cavity comprises a back wall at the rear portion of the golf club head; the back wall comprises the second cavity height measured perpendicular to the ground when the golf club head is at an address position from a lowest point of the second cavity to a top of the rear portion; and the second cavity height is approximately 0.28 inch (7.11 mm) to approximately 0.56 inch (14.22 mm).

18. The golf club of claim 5, wherein:

the second cavity comprises a second cavity length measured from the heel region to the toe region; and the second cavity length is approximately 1.4 inches (35.56 mm) to approximately 2.6 inches (66.04 mm).

19. The method of claim 9, wherein:

the first cavity comprises a first cavity length measured from the heel region to the toe region; and the first cavity length is approximately 1.5 inches (38.1 mm) to approximately 2.7 inches (68.58 mm).

20. The method of claim 9, wherein:

the second cavity comprises a back wall at the rear portion of the golf club head;

the back wall comprises the second cavity height measured perpendicular to the ground when the golf club head is at an address position from a lowest point of the second cavity to a top of the rear portion; and the second cavity height is approximately 0.28 inch inch (7.11 mm) to approximately 0.56 inch (14.22 mm).

21. The method of claim 9, wherein:

the second cavity comprises a second cavity length measured from the heel region to the toe region; and the second cavity length is approximately 1.4 inches (35.56 mm) to approximately 2.6 inches (66.04 mm).

22. The golf club head of claim 1, wherein: a rear side of the middle wall comprises a front wall of the second cavity that is closer to the strikeface than any other wall of the second cavity.

23. The golf club of claim 5, wherein: a rear side of the middle wall comprises a front wall of the second cavity that is closer to the strikeface than any other wall of the second cavity.

24. The method of claim 9, wherein: a rear side of the middle wall comprises a front wall of the second cavity that is closer to the strikeface than any other wall of the second cavity.

* * * * *